US008651600B2

(12) United States Patent
Cheong et al.

(10) Patent No.: US 8,651,600 B2
(45) Date of Patent: Feb. 18, 2014

(54) SHELF AND REFRIGERATOR WITH THE SAME

(71) Applicants: Minho Cheong, Changwon-si (KR); Moonseok Lee, Changwon-si (KR); Seonkyu Kim, Changwon-si (KR); Daesung Lee, Changwon-si (KR); Woonkyu Seo, Changwon-si (KR); Youngnam Kim, Changwon-si (KR)

(72) Inventors: Minho Cheong, Changwon-si (KR); Moonseok Lee, Changwon-si (KR); Seonkyu Kim, Changwon-si (KR); Daesung Lee, Changwon-si (KR); Woonkyu Seo, Changwon-si (KR); Youngnam Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 13/837,304

(22) Filed: Mar. 15, 2013

(65) Prior Publication Data

US 2013/0277323 A1 Oct. 24, 2013

(30) Foreign Application Priority Data

Apr. 20, 2012 (KR) ..... 10-2012-0041633
Jun. 7, 2012 (KR) ..... 10-2012-0061052

(51) Int. Cl.

| | |
|---|---|
| ***A47B 96/04*** | (2006.01) |
| *A47B 9/00* | (2006.01) |
| *A47B 43/00* | (2006.01) |

(52) U.S. Cl.
USPC ..... 312/408; 108/108; 108/110; 211/187

(58) Field of Classification Search
USPC ..... 211/90.01, 90.02, 90.04, 187, 153, 190, 211/192, 193, 133.3; 312/408, 410; 108/106–110; 248/221.11, 222.11, 248/221.12, 222.13, 241, 243; 403/263
See application file for complete search history.

(56) References Cited

U.S. PATENT DOCUMENTS 3,983,823 A * 10/1976 McDonnell ..... 108/147.11
6,644,609 B1 * 11/2003 Scott ..... 248/243

* cited by examiner

*Primary Examiner* — Jonathan Liu
*Assistant Examiner* — James Twomey
(74) *Attorney, Agent, or Firm* — KED & Associates, LLP

(57) ABSTRACT

A shelf and a refrigerator having such a shelf are provided. The shelf may include a support frame fixed to an inner surface of a storage compartment of the refrigerator, the support frame including body having a plurality of coupling holes formed along a longitudinal direction, spaced apart at predetermined intervals, and a cover coupled to the body to selectively open and close the plurality of the coupling holes. The cover may include a fixing portion for fixing the cover to the support frame body, and a plurality of opening/closing portions extending from the fixing portion, corresponding to the plurality of the coupling holes, to independently open and close the plurality of the coupling holes. One or more of the plurality of the opening/closing portions may be moved by the shelf plate to couple the shelf plate to the support frame.

23 Claims, 22 Drawing Sheets

SHELF AND REFRIGERATOR WITH THE SAME

CROSS-REFERENCE TO RELATED APPLICATIONS

This application claims priority under 35 U.S.C. §119 to Korean Application Nos. 10-2012-0041633 filed in Korea on Apr. 20, 2012 and 10-2012-0061052 filed in Korea on Jun. 7, 2012, whose entire disclosures are hereby incorporated by reference.

BACKGROUND

1. Field

Embodiments may relate to a shelf and a refrigerator with the same.

2. Background

A refrigerator may maintain storage items in a refrigerated and/or frozen state using cold air generated by a freezing cycle including a compressor, a condenser, an expansion valve and an evaporator. Such a refrigerator may be classified into a top freezer-type having a freezer compartment mounted at a top of a refrigerator compartment, a bottom freezer-type having a freezer compartment mounted under a refrigerator compartment, and a side by side-type having freezer and refrigerator compartments mounted side by side. A plurality of shelves for receiving storage items thereon may be provided in the freezer and/or refrigerator compartments, regardless of the particular arrangement of these compartments in the refrigerator.

BRIEF DESCRIPTION OF THE DRAWINGS

The embodiments will be described in detail with reference to the following drawings in which like reference numerals refer to like elements wherein.

DETAILED DESCRIPTION

Reference may now be made in detail to specific embodiments, examples of which may be illustrated in the accompanying drawings. Wherever possible, same reference numbers may be used throughout the drawings to refer to the same or like parts. Terminology used in the present specification selects common expressions well known and used currently, and the terminology may be varied by intensions of those who skilled in the air the present invention pertain to, practices or emergence of new technologies.

An internal space provided within a refrigerator compartment or a freezer compartment of a refrigerator may be partitioned by one or more shelves. A structure for adjusting the height of one of the shelves may include a cantilever plate hung on holes formed in a rear wall of the refrigerator, spaced apart a predetermined distance, and/or a plate hung on molded end structures formed in two opposite sidewalls of a refrigerator. Using a molded-end structure, a position of the shelf may be limited to positions specifically corresponding to the molded-ends. Using a cantilever structure, the shelf may be selectively arranged wherever the holes are available, thus providing for flexible shelf position selection compared with the molded-end structure.

However, in the cantilever structure, through-holes that are not in use. For supporting one of the shelves are exposed and visible when a door of a refrigerator is open, thus detracting from its appearance. Further, foreign objects may accumulate in the open through-holes, possibly causing odors and contamination in the refrigerator.

As refrigerator capacity increases, the plurality of shelf plates may be arranged not only in a vertical direction but also in a horizontal direction such that adjacent shelf plates may be arranged at different heights and be dislocated by the weight of items placed thereon.

Figure 1:
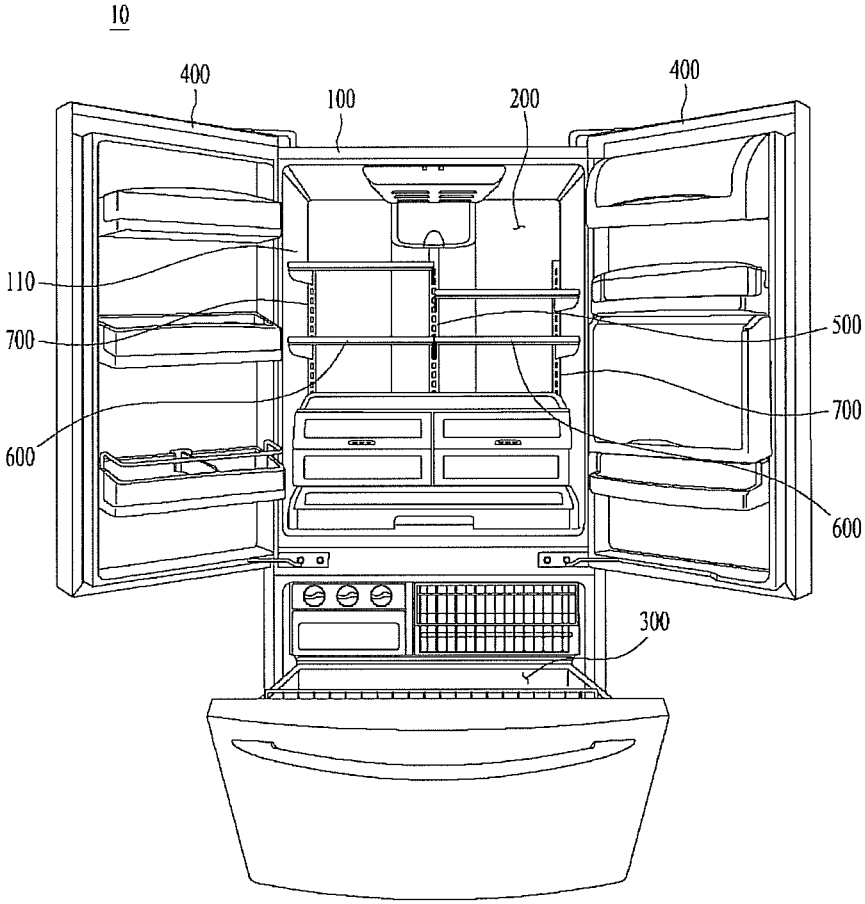
FIG. 1 is a front view of an exemplary shelf and a refrigerator including such a shelf, as embodied and broadly described herein.

FIG. 1 is a front view of a refrigerator 10 including a shelf, as embodied and broadly described herein.

The refrigerator 10 may include a refrigerator compartment 110 and a freezer compartment 300 closed by doors 400. A shelf 20 (see FIG. 2) may be installed in one of the compartments of the refrigerator 10, such as the refrigerator compartment 110, and may partition the compartment 110 into several spaces and have various containers placed thereon. The shelf 20 may include a shelf plate 600 supported by a support frame 500 and 1500.

The shelf 20 may be installed in various different types of apparatuses, such as, for example, the refrigerator 10 shown in FIG. 1. The shelf 20 may be installed in an inner case 100 of such a refrigerator, such as, for example, in the refrigerator compartment 110 formed in the inner case 100 where a storage room 200 is provided. In this instance, the storage room 200 may correspond to a section of the refrigerating compartment 110 partitioned by the shelf 20.

As mentioned above, the shelf 20 may be installed in various different apparatuses, and is shown installed in a refrigerator 20 simply for ease of explanation and illustration as follows.

The support frame 500 and 1500 may be fixed to a surface of the inner case 100 as shown in FIG. 1 to support the shelf plate 600. As shown in FIG. 1, the support frames 500 and 1500 may be arranged, for example, at or near corners formed between a rear wall and two opposite sidewalls of the inner case 100, and at or near a center of the rear wall. In this instance, as shown in FIG. 1, the support frame 1500 may be arranged at or near one (or both) of the corners and the support frame 500 may be arranged at or near the center of the rear wall.

In alternative embodiments, the support frames 500 and 1500 may be freely arranged on a predetermined wall of the inner case 100 according to the number, size and position of the shelf plates 600. For ease of explanation, the support frame installed on a flat wall of the inner case 100 will be referred to as a wall support frame 500 and the support frame installed at or near the corner of the inner case 100 will be referred to as a corner support frame 700.

The one or more shelf plates 600 may be coupled to the support frames 500 and 1500 and may partition the storage room 200 formed in the refrigerating compartment 110 in various different ways to utilize the storage space as needed.

Figure 2:
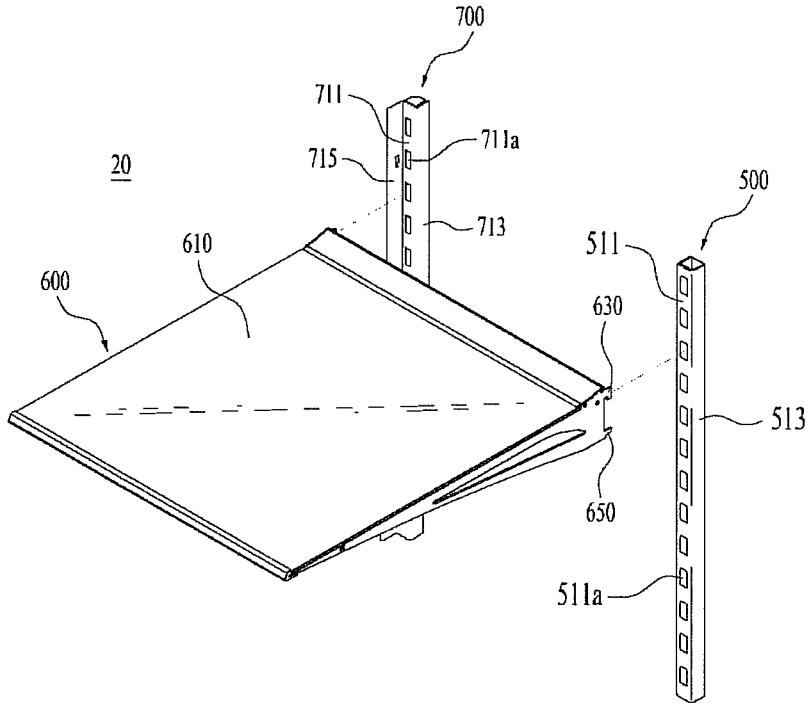
FIG. 2 is a perspective view of a support frame and a shelf plate of the shelf shown in FIG. 1.
Figure 3:
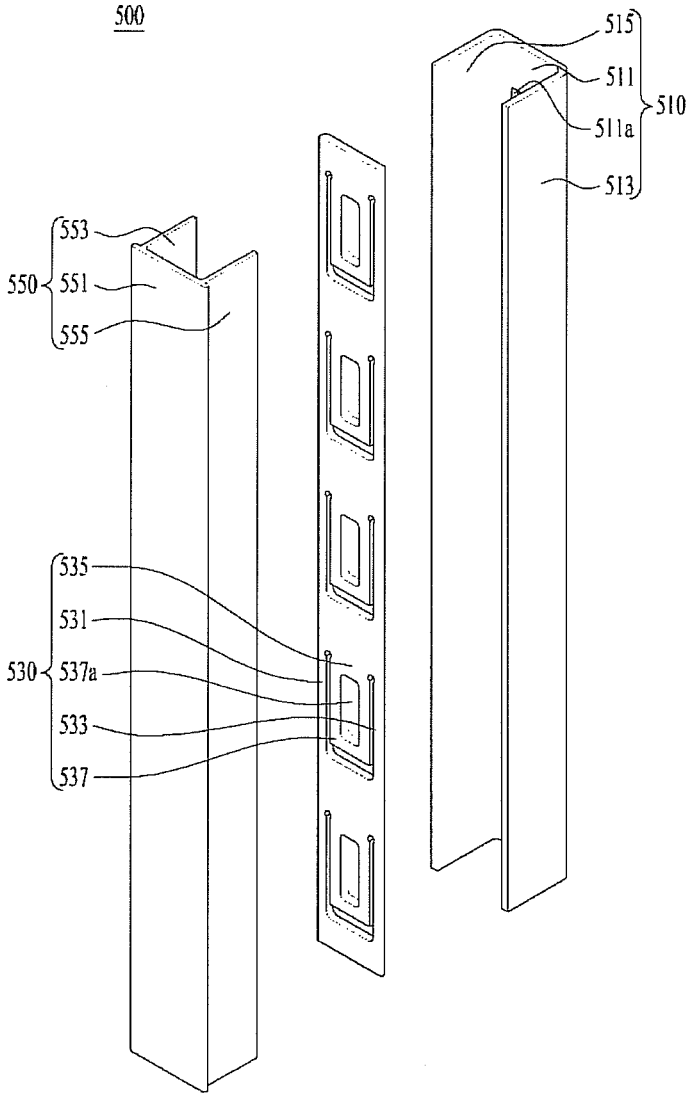
FIG. 3 is an exploded perspective view of the support frame shown in FIG. 2.
Figure 4:
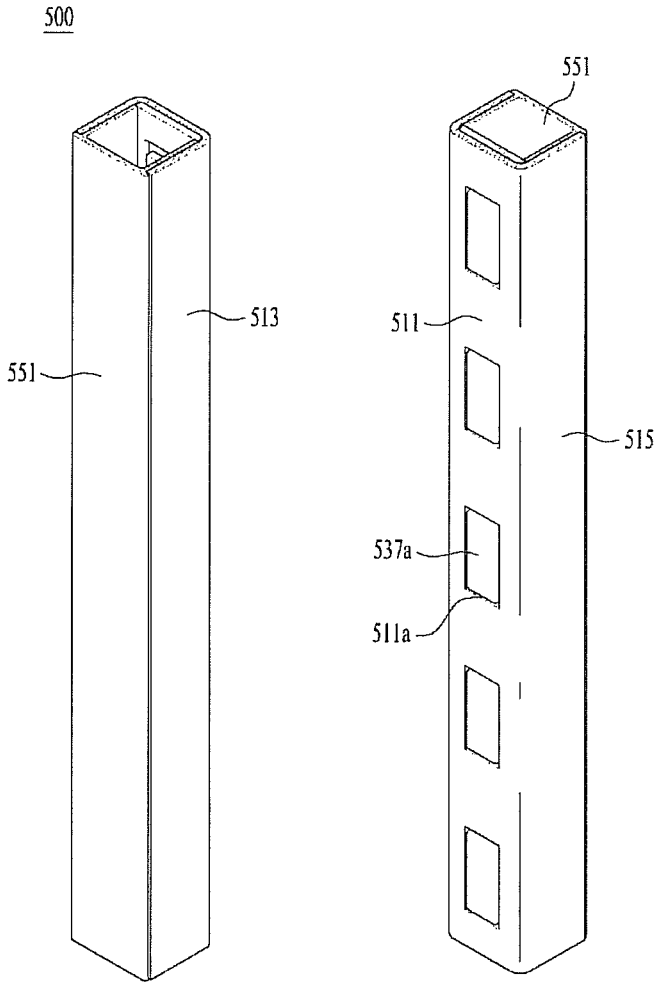
FIG. 4 is a perspective view of the support frame shown in FIG. 2.

Referring to FIGS. 2 to 4, the shelf 20 including the shelf plate 600 and support frames 500 and 1500 according to an embodiment will now be described.

The support frame 500 may include a support frame body 510, a cover 530 and a cover holder 550. As discussed above, in this embodiment, the support frame 500 may be the support frame that is installed on the flat wall of the inner case 100. However, in other embodiments, the support frame 500 may also be installed at or near one or both of the corners of the inner case 100.

Figure 7A:
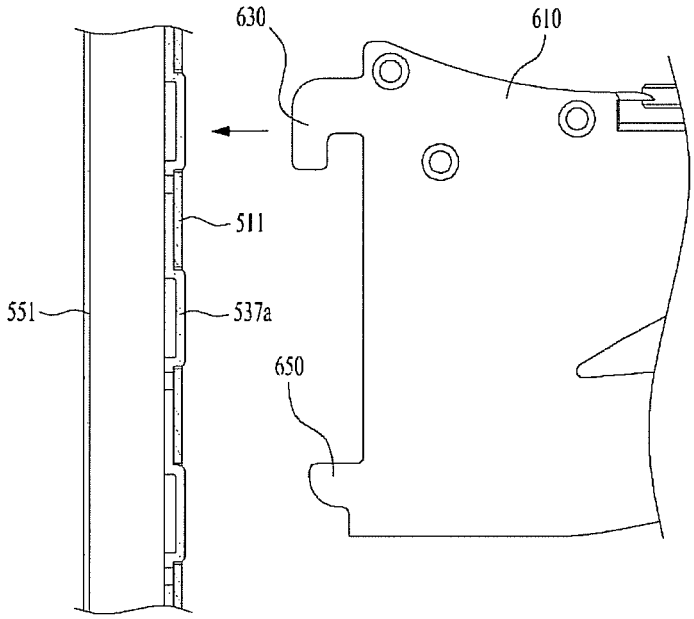
FIGS. 7A and 7B are sectional views of a relationship between the shelf plate and the support frame of the shelf shown in FIG. 2.
Figure 7B:
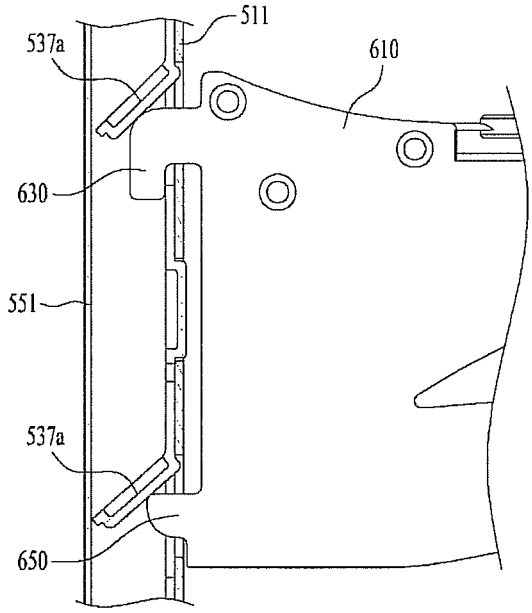

The support frame body 510 may define a profile of the support frame 500, and may include one or more coupling holes 511*a* formed in a front face 511, and first and second side faces 513 and 515. The coupling holes 511*a* may be through-holes formed in the support frame body 510 and arranged in a longitudinal direction, spaced apart a predetermined distance from each other. The coupling holes 511*a* may each receive one of the coupling hooks 630/650 of the shelf plate 600, as shown in FIGS. 7A and 7B. The number of coupling holes 511*a* and the distance between adjacent coupling holes 511*a* may be determined based on, for example, the number or size of the shelf plates 600 which will be installed in the inner case 100, and other such factors.

The front face 511 may define a front surface of the support frame body 510 that faces into the refrigerating compartment 110 and is accessible/visible and the coupling holes 511 may be formed in the front face 511. The first and second side faces 513 and 515 may respectively define side surfaces of the support frame body 510, and may extend from two opposite longitudinal edges of the front face 511. The first and second side faces 511 and 513 may be fixed to a predetermined wall of the inner case 100, to arrange the support frame 500 on a flat wall of the inner case 100.

As shown in FIGS. 3 and 4, a profile of the cover 530 may extend longitudinally along the direction of the support frame 500 and may be fixed to an inner surface of the support frame body 510 to selectively open and close the coupling holes 511*a*. The cover 530 may include a fixing portion, a connecting portion 535 and an opening/closing portion 537.

The fixing portion may be fixed to the inner surface of the support frame body 510 to fix the cover 530 to the inner surface of the support frame body 510. The fixing portion may include a first fixing portion 531 and a second fixing portion 533. The first and second fixing portions 531 and 533 may also fix the cover 530 along the longitudinal direction of the support frame body 510 and along two opposite edge areas of the coupling holes 511*a*. In particular, referring to FIG. 3, the first and second fixing portions 531 and 533 may be fixed to right and left edge areas of the coupling holes 511*a*. Accordingly, the first and second fixing portions 531 and 533 may fix the cover 530 to the inner surface of the support frame body 510 along the longitudinal direction of the support frame body 510.

The connecting portion 535 may connect the first and second fixing portions 531 and 533 with each other. The connecting portions 535 may extend vertically between two neighboring coupling holes 511*a*. Referring to FIG. 3, each connecting portion 535 may extend horizontally between the first and second fixing portions 531 and 533, to connect the first and second fixing portions 531 and 533 of a particular opening/closing portion 537. Simultaneously, each connecting portion 535 may extend vertically between two neighboring coupling holes 511*a*, without covering the coupling hole 511*a*.

When a coupling hook 630/650 of the shelf plate 600 is coupled to the coupling hole 511*a*, the connecting portions 535 may be spaced apart a predetermined distance from a lower portion of the coupling hole 511*a* so that the coupling hook 630 and 650 do not make contact (see FIG. 7B).

Each of the opening/closing portions 537 may extend from the fixing portion 531/533 and connecting portion 535 corresponding to a respective coupling hole 511*a*, to open and close the coupling holes 511*a*. The opening/closing portions 537 may be movable in response to insertion of the shelf plate 600 to selectively open a predetermined one of the coupling holes 511 a to which the shelf plate 600 is fixed.

Referring to FIG. 3, the connecting portions 535 may be provided in the cover 530 and the opening/closing portions 537 may be positioned between the first and second fixing portion 531 and 533 and between connecting portions 535, to cover a respective coupling hole 511*a*.

In certain embodiments, the hooks 630/650 of two shelf plates 600 placed side by side may be fixed in one coupling hole 511 a formed in the support frame 500 for the flat wall, as shown in FIG. 1.

Accordingly, the opening/closing portions 537 may extend from lower ends of the connecting portions 535 in a downward direction to cover the coupling holes 511*a* as shown in FIG. 3. As a result, the opening/closing portions 537 may close the corresponding coupling holes 511*a* from the inside of the support frame body 510 to open and close the corresponding coupling holes 511*a*. In particular, the opening/closing portions 537 may selectively open only the coupling holes 511*a* to which the shelf plate 600 is fixed.

Each of the opening/closing portions 537 may include an opening/closing pad 537*a* formed in a shape corresponding to the coupling hole 511*a* to be inserted in the coupling hole 511*a*.

Referring to FIG. 3, the opening/closing pad 537*a* may project from a front surface of the opening/closing portion 535 toward the coupling hole 511*a* and have a shape corresponding to the coupling hole 511*a*. Accordingly, as shown in FIG. 4, the opening/closing pads 537*a* may be positioned in the coupling holes 511*a* from the inside of the support frame body 510 so that the coupling holes 511*a* are filled with the pads 537*a*.

Various materials may be used for forming the cover 530, such as, for example, a rubber material having flexibility. The cover 530 may be integrally formed as a single body, for example, integrally formed by an injection molding process. Accordingly, the manufacturing process may be simple and manufacturing time may be reduced.

The cover holder 550 may be inserted in the support frame body 510 to press against and fix the first and second fixing portions 531 and 533. The cover holder 550 may include a contacting face 551 that contacts and is pressed by a corresponding wall of the inner case 100, and first and second pressing portions 553 and 555 that extend from the contacting face 551 to press against the first and second fixing portions 531 and 533 as the contacting face 551 is pressed.

Specifically, as shown in FIG. 3, the contacting face 551 may have a flat plate shape that extends longitudinally along the longitudinal direction of the support frame body 510 so that it may close an open surface formed by the first and second side faces 513 and 515 of the support frame body 510.

The first and second pressing portions 553 and 555 may be symmetrically formed and may extend from an inner surface of the contacting face 551 toward the first and second fixing portions 531 and 533, to be inserted in the support frame body 510 to contact the first and second fixing portions 531 and 533. The first and second pressing portions 553 and 555 may be broadened in an outward direction to prevent the cover holder 550 from easily separating from the support frame body 510.

A method for fixing the cover 530 in the support frame body 510 using the cover holder 550 will now be described. First, the cover 530 may be positioned in the support frame body 510, with the holes 511*a* and pads 537*a* aligned, and then the support frame body 510 may be coupled to the cover holder 550 so that the first and second pressing portions 553 and 555 contact the first and second fixing portions 531 and 533 of the cover 530.

Hence, the support frame 500 may be installed on one wall of the inner case 100. Accordingly, an outer/rear surface of the contacting face 511 contacts one wall of the inner case 100 and is pressed, causing the first and second pressing portions 553 and 555 to press the first and second fixing portions 531 and 533. In other words, the cover holder 550 may press and fix the first and second fixing portions 531 and 533.

The cover holder 550 may be made of various different materials, such as, for example, an elastic material to ease the separation and coupling process with respect to the support frame body 510. The cover holder 550 may integrally formed using an extrusion molding process. Accordingly, the manufacturing process may be simple and manufacturing time may be reduced, and the assembling time taken to couple the cover holder 550 to the support frame body 510 may be reduced.

As shown in FIG. 2, coupling hooks 630 and 650 of the shelf plate 600 may be fixed to the coupling holes 511*a* of the support frame 510 to mount the shelf plate 600 to the support frame 500 and the shelf 20 in the inner case 100. The shelf plate 600 may include a shelf plate body 610 that defines a profile, or a receiving/storage surface, of the shelf plate 600 so that storage items may be placed on the shelf plate body 610.

The coupling hooks 630/650 may be formed at each end, i.e., left and right ends, of a rear surface of the shelf plate body 610 and inserted into respective coupling holes 511*a* to couple the shelf plate 600 to the support frame 500. The coupling hooks may include a first hook 630 and a second hook 650. The first hook 630 may be formed at an upper corner area of the rear surface of the shelf plate body 610 and may have a hook shape such as, for example, a "¬". Accordingly, the first hook 630 may securely hooked into a corresponding coupling hole 511*a*. The first hook 630 may push the opening/closing portion 537 and the opening/closing pad 537*a* that covers the coupling hole 511*a* to open the coupling hole 511*a* for receiving the first hook 630 (see FIG. 7B).

The second hook 650 may be formed at a lower corner area of the rear surface of the shelf plate body 610. The second hook 650 may be a protrusion that projects toward the coupling hole 511*a* from the lower corner area. The second hook 650 is not necessarily fixed to the coupling hole 511*a* but pushes the opening/closing portion 537 and the opening/closing pad 537*a* to open the coupling hole 511*a* and allow the second hook 650 to be received therein, but not necessarily securely engaged (see FIG. 7B).

Figure 5:
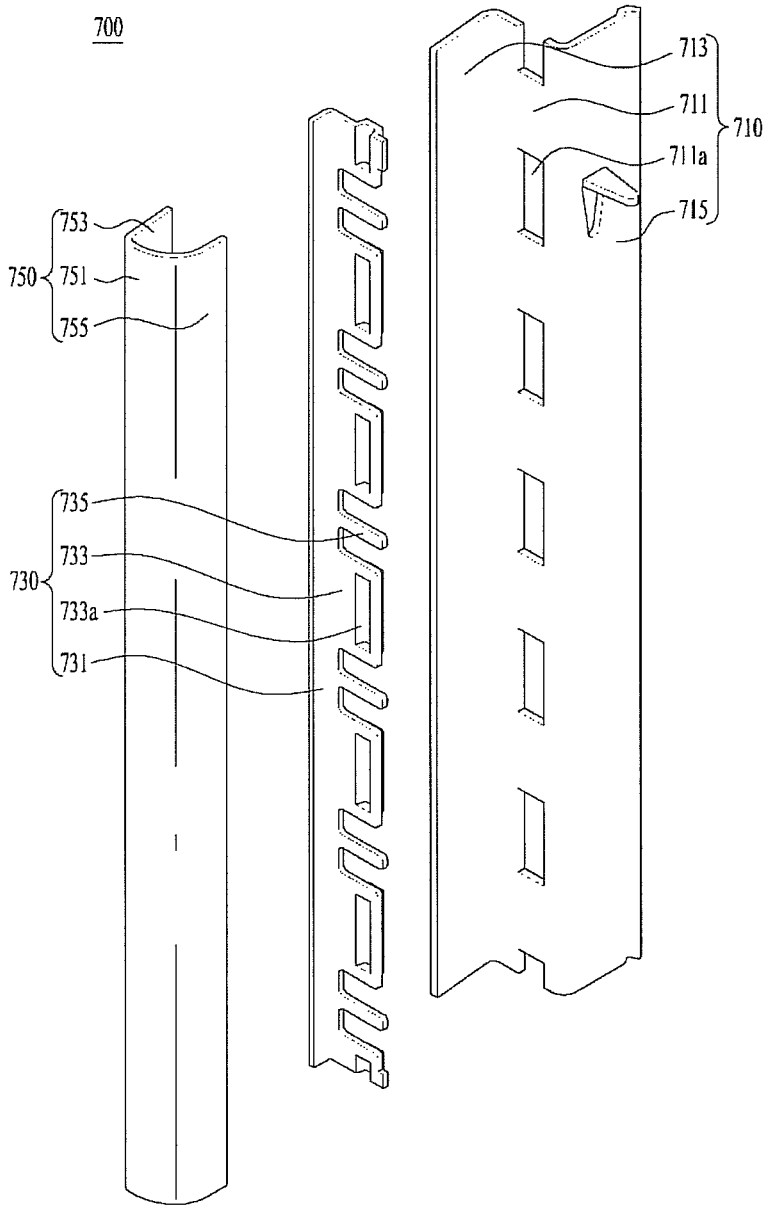
FIG. 5 is an exploded perspective view of a support frame provided in a shelf in accordance with another embodiment as broadly described herein.
Figure 6:
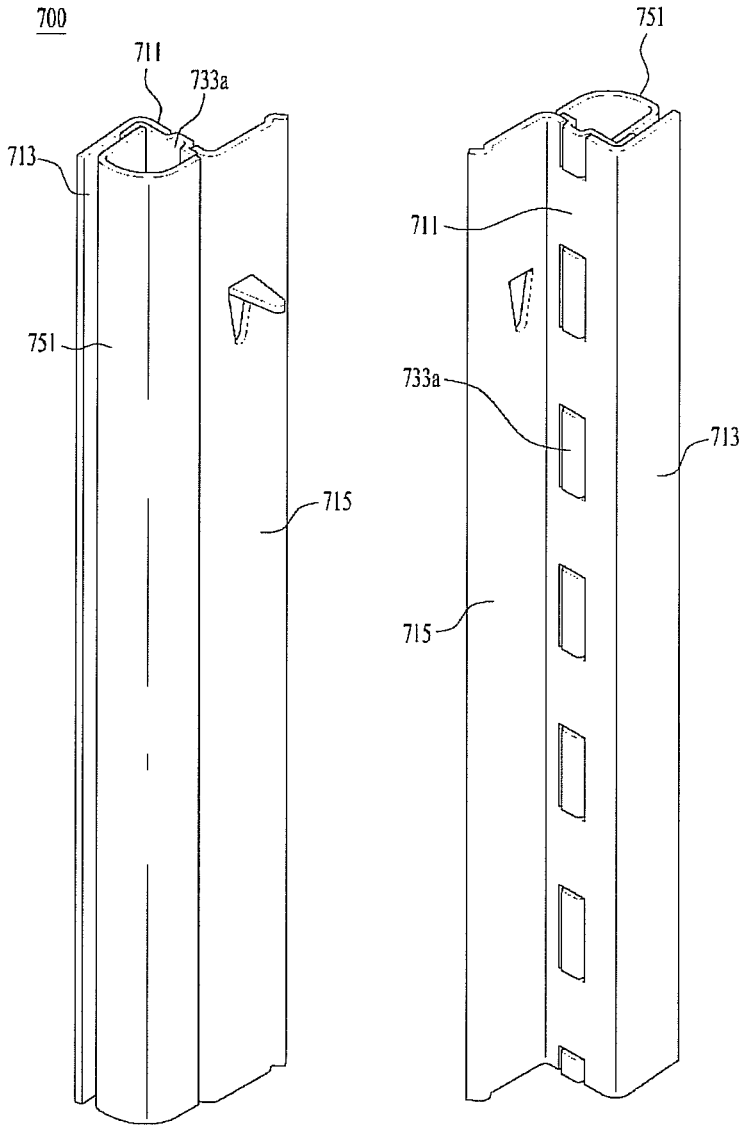
FIG. 6 is a perspective view of the support frame shown in FIG. 5.

FIG. 5 is an exploded perspective view of a support frame 700 provided with a shelf according to another embodiment and FIG. 6 is an assembled perspective view of the support frame 700 shown in FIG. 5.

The support frame 700 according to this embodiment may include a support frame body 710, a cover 730 and a cover holder 750. The support frame 700 may be installed at or near the corner of the inner case 100 as shown in FIG. 1. The support frame body 710 may define a profile of the support frame 700, and may include a front face 711, a plurality of coupling holes 711*a* and first and second side faces 1513 and 715. The front face 711 may define a front surface of the support frame body 710 and the coupling holes 711*a* may be formed in the front face 711. The first side face 713 may extend back from an end of the front face 711 and the second side face 715 may extend forward from the other end of the front face 711.

In other words, in the wall support frame 500 discussed above, the first and second side faces 513 and 515 both extend back from the front face 511. In contrast, in the corner support frame 700 shown in this embodiment, the first and second side faces 713 and 715 of the corner support frame 700 extend in different directions.

The second side face 715 may be fixed to one sidewall of the inner case 100, and the first side face 713 may extend back toward the rear wall, to arrange the support frame 700 in the corner of the inner case 100.

As shown in FIG. 5, the cover 730 may extend longitudinally along a longitudinal direction of the support frame body 710, and the cover 730 may be fixed to an inner surface of the support frame body 710 to selectively open and close the coupling holes 711*a*, and may include a fixing portion and an opening/closing portion 733.

The fixing portion may be fixed to the inner surface of the support frame body 710 to fix the cover 730 to the inner surface of the support frame body 710. The fixing portion may include first and second fixing portions 731 and 735. The first fixing portion 731 may longitudinally fix the cover 730 to the support frame body 710 along left and/or right edge areas of the coupling holes 711*a*. The first fixing portion 731 may extend longitudinally along the longitudinal direction of the support frame body 710 and may be fixed along right or left edge areas of the coupling holes 711*a* to fix the cover 730 to an inner surface of the support frame body 710. The second fixing portion 735 may extend from the first fixing portion 731 and may extend to the other edge areas of the coupling holes 711*a* so as to pass between two neighboring coupling holes 711*a*.

Referring to FIG. 5, the second fixing portion 735 may extend horizontally from the first fixing portion 731 to the other edge areas of the coupling holes 711*a* from the right or left edge areas of the coupling holes 711*a* to which the first fixing portion 731 is fixed. The second fixing portion 735 may extend between each set of neighboring coupling holes 711*a* so as to not cover the coupling holes 711*a*. When a coupling hook 630/650 of the shelf plate 600 is fixed in one of the coupling holes 711*a*, the second fixing portion 735 may be spaced apart a predetermined distance from a lower portion of the coupling hole 711*a* so that the coupling hook 630/650 does not make contact.

As shown in FIG. 5, the opening/closing portions 733 may extend horizontally from the first fixing portions 731 to at least partially cover corresponding coupling holes 711*a*.

In this embodiment, the support frame 700 is installed at or near the corner and only one coupling hook is secured in one coupling hole 711*a*. Accordingly, even when the opening/closing portion 733 directly extends from the first fixing portion 731 in the horizontal direction, over-transformation, or displacement, of the opening/closing portion 733 may be avoided.

As shown in FIG. 5, the opening/closing portion 733 may include an opening/closing pad 733*a* having a shape corresponding to the coupling hole 711*a* so as to be inserted in the coupling hole 711*a*. The opening/closing pad 733*a* may project toward the coupling hole 711*a* from the opening/closing portion 733 and the opening/closing pad 733*a* may be inserted in the coupling hole 711*a* from the inside of the support frame body 710 so that the coupling hole 711*a* is filled by the opening/closing pad 733*a*.

The cover holder 750 may be arranged between the support frame body 710 and one wall of the inner case 100. The cover holder 750 may include a contacting face 751 in contact with one wall of the inner case 100 so as to be pressed, and first and second pressing portions 753 and 755 that each extend from the contacting face 751 to press against the first and second fixing portions 731 and 735 as the contacting face 751 is pressed.

Referring to FIG. 5, the cover holder 750 may extend longitudinally along a longitudinal direction of the support frame body 710. The first and second pressing portions 753 and 755 may extend from the contacting face 751, which contacts a rear wall of the inner case 100.

An outer surface of the first pressing portion 753 may have a predetermined shape corresponding to the shape of the inner surface of the first side face 713 of the body 710 and an end of the first pressing portion 753 may contact the first fixing portion 731. The second pressing portion 755 may have a curved shape and an end of the second pressing portion 755 may contact the second fixing portion 735 and one wall of the inner case 100, such as a wall adjacent to the rear wall defining a corner therebetween.

Thus, in this arrangement, the first and second pressing portions 753 and 755 may fix the cover holder 750 to the support frame body 710 through contact with the first and second fixing portions 731 and 735, respectively. For example, an outer surface of the first pressing portion 753 may be adhered to the inner surface of the first side face 713 using, for example, a double-sided tape to fix the cover holder 750 to the support frame body 710 before arranging the support frame body 710 at or near the corner of the inner case 100. Hence, the support frame body 710 having the cover holder 750 fixed thereto may be arranged at or near the corner of the inner case 100.

Accordingly, the contacting face 751 of the cover holder 750 may contact the rear wall of the inner case 100 and be pressed, and then the first and second pressing portions 753 and 755 may press and fix the first and second fixing portions 711 and 713 of the support frame body 710, respectively. In other words, the cover holder 750 presses against the first and second fixing portions 731 and 735 of the cover 730 to fix the cover 730 in the support frame body 710.

In an alternative embodiment, the outer surface of the second pressing portion 755, instead of the contacting face 751, may contact one sidewall of the inner case 100 and be pressed, and then the outer surface of the second pressing portion 755 may be pressed to strengthen the adhesion between the first pressing portion 753 and the first side face 713 of the support frame body 710 adhered by the double-sided tape.

When a predetermined area of the first fixing portion 731 of the cover 730 is extends at a curve to contact the inner surface of the first side face 713 of the support frame body 710 as shown in FIG. 5, not only the end but also the outer surface of the first pressing portion 753 may press against the first fixing portion 731 of the cover 730.

As the first pressing portion 753 presses the first fixing portion 731, the second fixing portion 735 may assist the first fixing portion 731 in firmly fixing the cover 730 even when the coupling hole 711*a* is open. Accordingly, even when a specific opening/closing portion 733/pad 733*a* is pushed by the coupling hook of the shelf plate 600, the influence of such pushing may not be exerted on a neighboring opening/closing portion 733/pad 733*a* and the selective opening of the coupling holes 711*a* may be enabled.

The support frame 700 according to this embodiment may be vertically symmetrical so that it may be freely arranged in either corner of the inner case 100 without distinction of right and left.

Figure 8A:
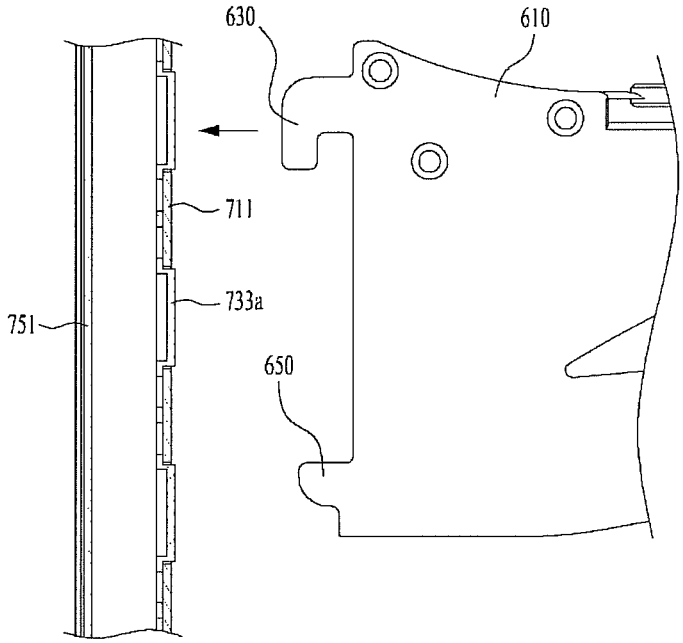
FIGS. 8A and 8B are sectional views of a coupling relationship between a shelf plate and a support frame of the shelf according shown in FIG. 5.
Figure 8B:
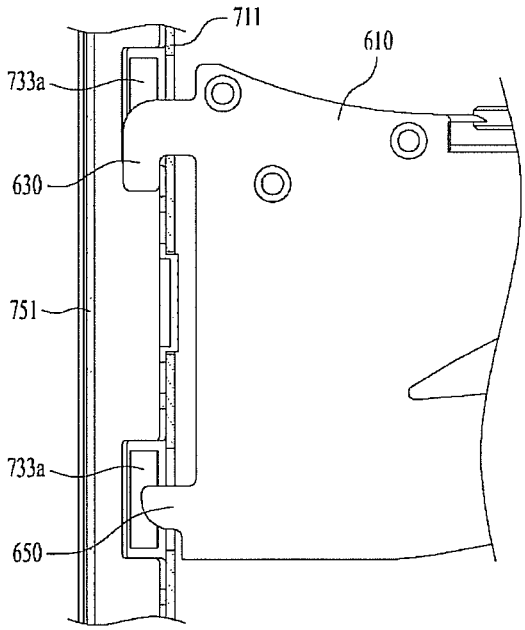

FIGS. 7A and 7B are sectional views of the relationship between the shelf plate 600 and the support frame 500 according to the embodiment shown in FIGS. 3 and 4. FIGS. 8A and 8B are sectional views of the coupling relationship between the shelf plate 600 and the support frame 700 according to the embodiment shown in FIGS. 5 and 6.

As shown in FIGS. 1 and 2, it will be assumed, for ease of explanation, that the support frame 500 for the flat wall, or wall support frame 500, is arranged on the rear wall of the inner case 100 and that the support frame 700 for the corner, or corner support frame 700, is arranged at the right and left corners of the inner case 100.

As mentioned above, first and second coupling hooks 630 and 650 may be provided at right and left ends of the rear surface of the shelf plate 600. Accordingly, two pairs of first and second coupling hooks 630 and 650 may be inserted in the coupling holes 511*a* and 711*a* provided in the wall support frame 500 and the corner support frames 700 to couple the shelf plate 600 to the support frame 500 and 700.

First, as shown in FIGS. 7A and 7B, the first and second coupling hooks 630 and 650 may be inserted in the coupling holes 511*a* of the wall support frame 500.

Before insertion of the first and second coupling hooks 630 and 650, the coupling hole 511*a* may be closed or blocked by the opening/closing portion 537 and the opening/closing pad 537*a* as shown in FIG. 7A.

As the first and second coupling hooks 630 and 650 are inserted in the coupling hole 511*a*, the opening/closing portion 537, and in particular, the opening/closing pad 537*a* may be pushed backward by the first and second coupling hooks 630 and 650. In this instance, an upper end of the opening/closing pad 537 may be connected with the connecting portion 535. As the opening/closing pad 537*a* rotates about an upper end thereof, the opening/closing portion 537 opens the coupling hole 511*a* and allows the hooks 630 and 650 to be inserted, as shown in FIG. 7B.

Even when the first and second coupling hooks 630 and 650 are inserted in the coupling holes 511*a*, the fixed state of the cover 530 may be maintained by the first and second fixing portions 531 and 533. Accordingly, the remaining coupling holes 511*a* (the coupling holes 511*a* not having the first and second coupling hooks 630 and 650 inserted therein) may still be closed by the remaining opening/closing portions 537.

In other words, as the opening/closing portion 537 is provided in the cover member 530, only the coupling holes 511*a* having the first and second coupling hooks 630 and 650 inserted therein may be open, thus providing a more finished appearance.

As shown in FIGS. 8A and 8B, the first and second coupling hooks 630 and 650 at the opposite end of the shelf plate 600 may be inserted in the coupling holes 711*a* of the corner support frame 700. Before the first and second coupling hooks 630 and 650 are inserted in the coupling holes 711*a*, the coupling holes 711*a* are closed by the opening/closing portion 733 and the opening/closing pad 733*a*. As the first and second coupling hooks 630 and 650 are inserted in the coupling holes 711*a*, the corresponding opening/closing portion 733/pad 733*a* is pushed backward by the first and second coupling hooks 630 and 650. Different from the wall support frame 500 discussed above, a vertical end/edge of the opening/closing portion 733 provided in the corner support frame 700 may be connected with the first fixing portion 731 and may rotate about end thereof connected with the first fixing portion 731 to open the coupling holes 711*a* for insertion of the coupling hooks 630 and 650, as shown in FIG. 8*b*.

Even when the first and second coupling hooks 630 and 650 are inserted in the coupling holes 711*a* of the corner support frame 700, the cover 730 may remain fixed by the first and second fixing portions 731 and 733. Accordingly, the opening/closing portion 733 may selectively open only the coupling holes 711*a* having the first and second coupling hooks 630 and 650 inserted therein.

According to embodiments as broadly described herein, only the coupling holes 511*a* and 711*a* having coupling hooks 630 and 650 inserted therein may be selectively opened at the opening/closing portions 537 and 733, while the remaining coupling holes remain closed. Accordingly, foreign matter may be prevented from being drawn into the support frames 500 and 700 via the coupling holes 511*a* and 711*a* and refrigerator hygiene may be enhanced, and an outward appearance may be more aesthetically pleasing.

Figure 9:
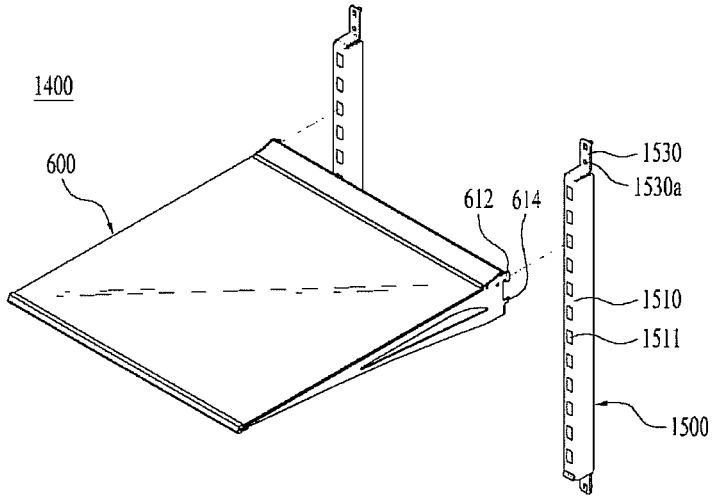
FIG. 9 is an exploded perspective view of a shelf assembly for a refrigerator according to an embodiment as broadly described herein.

A shelf assembly 1400 for a refrigerator as shown in FIG. 9 may be installed in a storage compartment of a refrigerator 10. Such a shelf 1400 may include a support frame 1500 and a shelf plate 600. The support frame 1500 is provided with a support frame body 1510 having a plurality of coupling holes 1511 spaced apart a predetermined distance from each other along a longitudinal direction and a hole cover 1520 opening and closing the plurality of coupling holes 1511. The shelf plate 600 may be fixed to the coupling holes 1511 and may partition the storage compartment into a plurality of storage spaces. The hole cover 1520 may be movably inserted in each of the coupling holes 1511 to open and close each of the coupling holes 1511. The hole cover 1520 may include a plurality of hole buttons 1522 each configured to selectively open only the one of the coupling holes 1511 when the shelf plate 600 is fixed thereto, while being moved by the shelf plate 600 fixed to the one of the coupling holes 511.

The shelf assembly 1400 may include the support frame 1500 fixed to an inner surface of the refrigerator compartment 110 and the shelf plate 600 coupled to the support frame 1500 to partition the internal chamber of the refrigerator compartment 110.

The number of the shelf plates 600 installed on the support frame 1500 is not limited to a specific value number. For example, a plurality of shelf plates 600 may be provided in various ways, for example, in predetermined steps or in two or more columns.

A pair of support frames 1500 may fix the shelf plate 600. Taking into consideration various arrangements of the shelf plate 600, a plurality of support frames 1500 may be provided.

For convenience of illustration and explanation, the plurality of shelf plates 600 may be arranged in two columns and partition the refrigerator compartment 110, with three corresponding support frames 1500 arranged at end portions and a center portion of a rear surface of the refrigerator 10, respectively.

Figure 10:
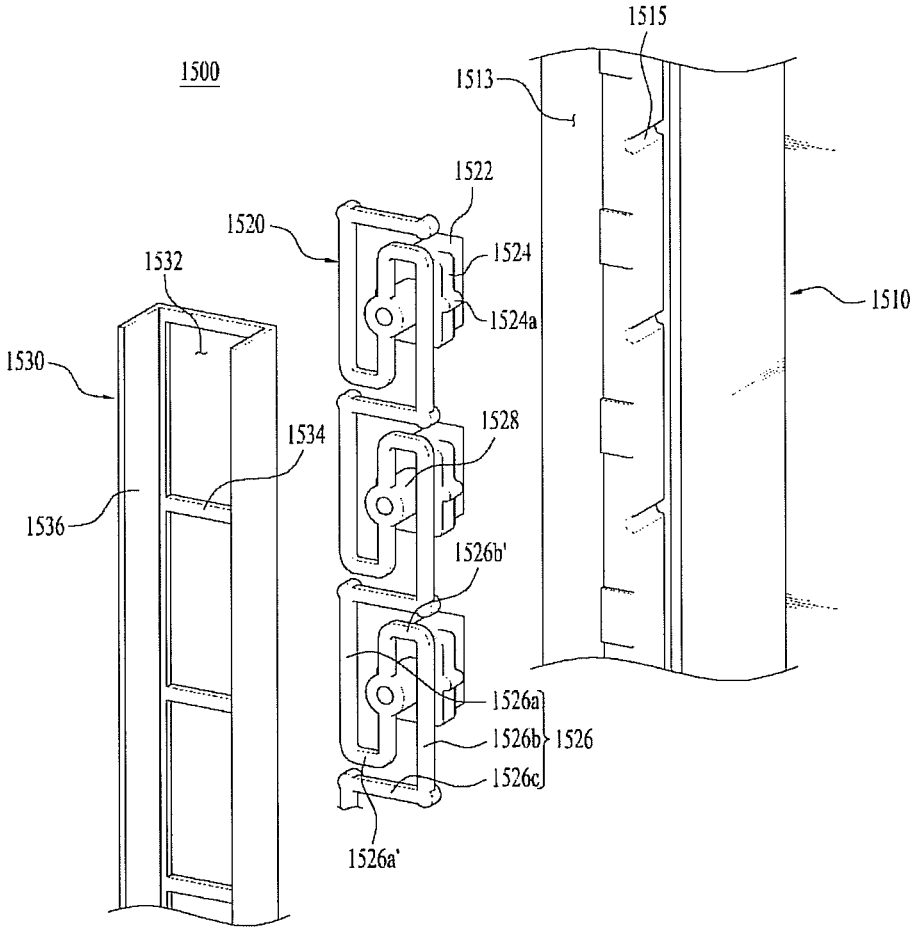
FIG. 10 is an exploded perspective view of a support frame shown in FIG. 9.

As shown in FIG. 10, a frame body 1510 may be fixed to a surface 110 of the refrigerator compartment 110 to define an exterior appearance of the support frame 1510. The frame body 1510 may include a plurality of coupling holes 1511 and a plurality of openings 1513.

The frame body 1510 may be fixed to a rear surface of the refrigerator compartment 110, fastened to the rear surface of the refrigerator compartment 110 by an appropriate fastener via a fastening hole 1530*a* provided in fastening parts 1530 extending from upper and lower ends of the frame body 1510, respectively.

The coupling holes 1511 may pass through a predetermined portion of the frame body 1510, and the shelf plate 600 may be detachably secured to one of the coupling holes 1511.

The plurality of coupling holes 1511 may be in a front surface of the frame body 1510, spaced apart a predetermined distance from each other along a longitudinal direction of the frame body 1510. In this exemplary embodiment, the coupling hole 1511 having a rectangular shape is shown. Such coupling holes 511 may have various other shapes as appropriate.

Accordingly, a user may selectively fix the shelf plate 600 to one of the coupling holes 1511 to adjust the height of the shelf plate 600. The openings 1513 may provide a passage where a hole cover 1520 and a cover holder 1530 are fixedly inserted. The other surfaces of the coupling holes 1511 formed in the frame body 1510 may be open to form the openings 1513 (see FIG. 10).

As mentioned above, the open shapes of the coupling holes may be exposed and visible when the refrigerator door is open, detracting from the appearance of the refrigerator 10 and allowing foreign matter to be drawn into the coupling holes 1511.

To address these issues, the support frame 1500 may include a hole cover 1520.

Such a hole cover 1520 may open and close the coupling holes 1511 of the frame body 1510. The hole cover 1520 may include a plurality of hole buttons 1522 and a separation preventing protrusion 1524.

Figure 11:
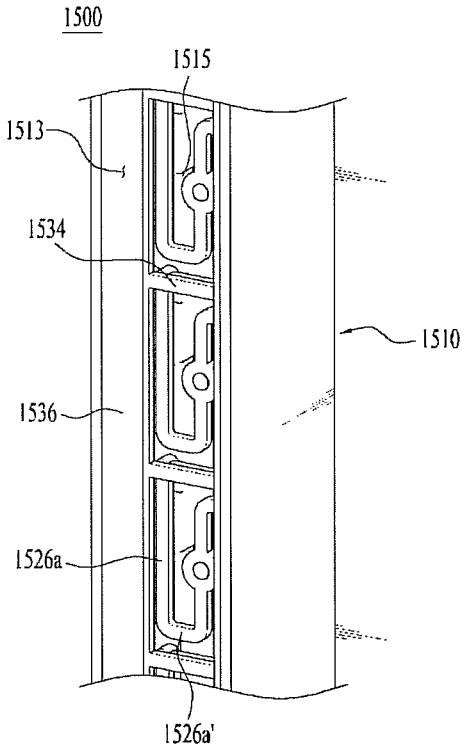
FIG. 11 is a rear perspective view of the support frame shown in FIG. 10.

The hole cover 1520 may be inserted in the frame body 1500 via the opening 1513 of the frame body 1500 and may have a predetermined shape corresponding to an inner surface of the frame body 1500. After the hole cover 1520 is inserted in the frame body 1500, the cover holder 1530 may be inserted in the opening as shown in FIG. 11 to support the hole cover 1520. The hole button 1522 may be movably inserted in the coupling hole 1511 to open and close the coupling hole 1511. In certain embodiments, a plurality of hole buttons 1522 may be provided to open and close the coupling holes 1511, respectively.

Figure 12A:
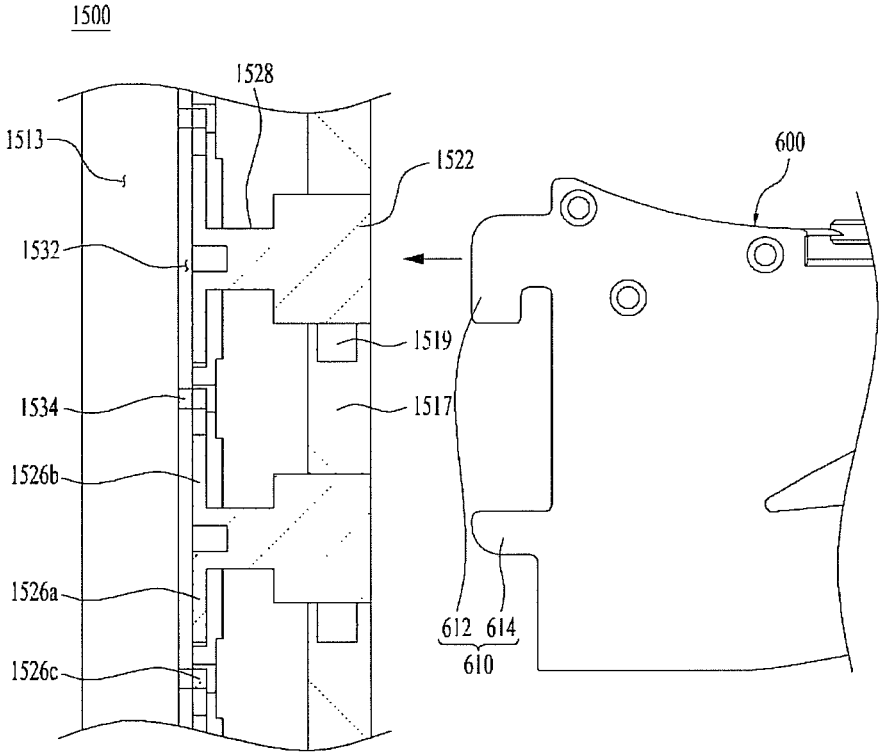
FIGS. 12A and 12B illustrate coupling between the support frame and a shelf plate of the shelf assembly shown in FIG. 9.
Figure 12B:
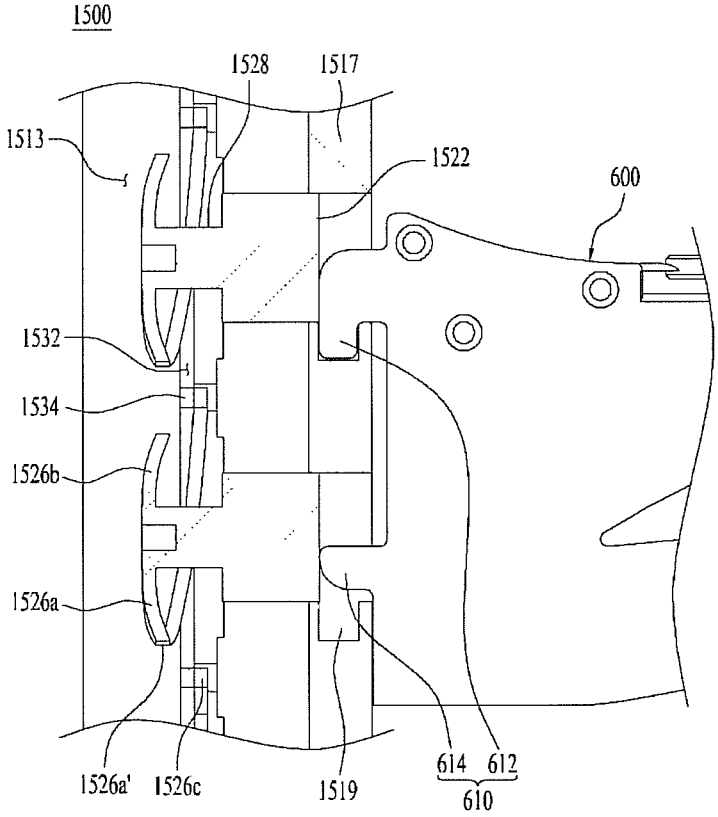

The plurality of hole buttons 1522 may be movably inserted in the coupling holes 1511 via the openings 1513, respectively, such that they may open or close corresponding coupling holes 1511, as shown in FIG. 12B. Specifically, only the hole button 1522 inserted in the coupling hole 1511 having the shelf plate 600 fixed thereto may be pulled back to open the corresponding coupling hole 1511, while the other hole buttons 1522 remain in a position closing the remaining coupling holes 1511.

In other words, each of the hole buttons 1522 may selectively open or close the corresponding coupling hole 1511 independently in communication with each of the coupling holes 1511. The separation preventing protrusion 1524 may extend from an outer circumferential surface of the hole button 1522 and may prevent the hole button 1522 from separating from the coupling hole 1511.

As shown in FIG. 10, the separation preventing protrusion 1524 may extend from two opposite ends of a rear surface of the hole button 522 to prevent the hole button 1522 from separating in a forward direction with respect to the frame body 1500 via the coupling hole 1511. The separation preventing protrusion 1524 may include an auxiliary guide 1524*a* projected from a predetermined portion thereof to guide the motion of the hole button 1522.

The auxiliary guide 1524*a* may be projected from a middle end portion of the separation preventing protrusion 1524. Corresponding to the auxiliary guide 1524*a*, an auxiliary guide groove 1515 may be formed in an inner surface of the frame body 1500 to move in a state of having the auxiliary guide 1524*a* inserted therein. Accordingly, the auxiliary guide 1524*a* may help a guide 1517 of the frame body 1500 to guide the motion of the hole button 1522 such that the balance of the hole cover 1520 may be maintained more effectively.

FIG. 12A illustrates a shelf plate before it is insertedly fixed to a securing groove of a frame body, and FIG. 12B illustrates the shelf plate after it is insertedly fixed to the securing groove of the frame body.

As mentioned above, the hole cover 1520 is provided in the support frame 1500, and the frame body 1500 may further include a guide 1517 configured to guide the motion of the hole cover 1520 and a securing groove 1519 configured to securely insert a coupling part 610 of the shelf plate 600. The guide 1517 may extend inward from the coupling hole 1511 to guide the motion of the hole button 1522.

As shown in FIG. 12A, the guide 1517 may extend a predetermined distance along an outer circumferential surface of the coupling hole 1511 toward the inside of the frame body 1510. Accordingly, as shown in FIG. 12B, when the shelf plate 600 is secured to the coupling hole 1511, the guide 1517 may guide the motion of the hole button 1522 pulled by the shelf plate 1600.

To secure the shelf plate 600 to the coupling hole 1511, while pulling the hole button 1522, the shelf plate 600 may further include a coupling part 610 formed in a predetermined portion of the shelf plate 600 to be inserted into and secured to the coupling hole 1511.

The coupling part 610 may be formed at two opposite ends of a rear surface of the shelf plate and may include a first coupling part 612 and a second coupling part 614. The first coupling part 612 may be formed at an upper portion of the rear surface of the shelf plate 600, with a hook shape. The second coupling part 614 may be formed at a lower portion of the rear surface of the shelf plate 600, as a projection extending toward the coupling hole 1511.

As shown in FIG. 12B, once the coupling part 610 is inserted in the coupling hole 1511, the hole button 1522 arranged in the coupling hole 1511 having the coupling part 610 inserted therein may be pulled by the coupling part 610 and the coupling part 610 may selectively open the coupling hole 1511 having the coupling part 610 inserted therein.

To facilitate insertion of the coupling part 610 into the coupling hole 1511, the support frame 1500 may further include securing groove 1519 where the coupling part 610 of the shelf plate 600 is securely inserted. In particular, the guide 1517 may be recessed a predetermined depth to form the securing groove 1519 as shown in FIG. 12A.

Accordingly, once the first coupling part 612 having the hook shape is securely inserted in the securing groove 1519, the rear surface of the shelf plate 600 may be supported by the frame body 1500 and the shelf plate 600 may be secured to the coupling hole 1511. Moreover, the second coupling part 614 is shaped like a projection extending toward the coupling hole 1511, and is not inserted in the securing groove 1519.

When the shelf plate 600 is separated from the coupling hole 1511, the hole button 1522 pulled by the coupling part 610 returns to an original position. For that, when the shelf plate 600 is separated from the coupling hole 1511, the hole cover 1520 may further include a restoration part configured to restore the hole button 1522 to an original position. The original position of the hole button 1522 may refer to a position where the hole button 1522 once again closes the coupling hole 1511. Such a restoration part may have various structures. For example, the restoration part may include a plurality of elastic ribs 1526 configured to provide an elastic force to the hole buttons 1522. Such a plurality of elastic ribs 1526 may include a first elastic rib 1526*a*, a second elastic rib 1526*b* and a connection rib 1526*c*.

The first elastic rib 1526*a* may extend from the hole button 1522 in a first direction and the second elastic rib 1526*b* may extend from the hole button 1522 in opposite second direction opposite the first direction. The first and second elastic ribs 1526*a* and 1526*b* may include bent portions 1526*a*' and 1526*b*' to provide the elastic force. The hole cover 1520 may further include a projected portion 1528 projected from a rear surface of the hole button 1522. The first and second elastic ribs 1526*a* and 1526*b* may extend from the projected portion 1528.

The connection rib 1526*b* may connect the first and second elastic ribs 1526*a* and 1526*b* provided in one of the hole buttons 1522 with the first and second elastic ribs 1526*a* and 1526*b* provided in a neighboring one of the hole buttons 1522.

Referring to FIG. 12B, the projected portion 1528 may project from the rear surface of the hole button 1522 to a predetermined length. The first and second elastic ribs 1526*a* and 1526*b* may extend from the projected portion 1528. Accordingly, the first and second elastic ribs 1526*a* and 1526*b* may be spaced apart a predetermined distance from the hole button 1522 by the projected portion 1528 to secure a predetermined space in which the first and second elastic ribs 1526*a* and 1526*b* may be elastically deformed.

In certain embodiments, the first elastic rib 1526*a* may extend toward a neighboring elastic rib 1526 provided beyond and the second elastic rib 1526*b* may extend toward another neighboring elastic rib 1526 provided below.

In certain embodiments, to provide an improved elastic force, the first and second elastic ribs 1526*a* and 1526*b* may include bent portions 1526*a*' and 1526*b*' bent in a "U" shape at middle end portions thereof, respectively, as shown in FIG. 10.

Once the bent portions 1526*a*' and 1526*b*' are provided, the first elastic rib 1526*a* may extend from the projected portion 1528 toward the elastic rib 1526 located below and bent in a "U" shape, so as to extend toward another elastic rib 1526 located beyond. Also, the second elastic rib 1526*b* may extend in an opposite direction with respect to the first elastic rib 1526*a*. Accordingly, the first and second elastic ribs 1526*a* and 1526*b* may be formed in a whelk shape as shown in FIG. 10. However, embodiments are not limited thereto and the first and second elastic ribs 1526*a* and 1526*b* may have various other shapes to provide appropriate elastic force to the hole buttons 1522.

As shown in FIG. 10, the connection rib 1526*c* may extend from the first elastic rib 1526*a* of one of the elastic ribs 1526 and the second elastic rib 1526*b* of the neighboring elastic rib 1526, to connect them with each other.

As the first and second elastic ribs 1526*a* and 1526*b* provided at neighboring elastic ribs 1526, respectively, are connected by the connection ribs 1526*c*, the elastic ribs 1526, the projected portions 1528 and the hole buttons 1522 may have an essentially continuous serial structure without disconnection or interruption.

In other words, the hole cover 1520 may have an integral structure which may connect the components without disconnection or interruption. Accordingly, the components of the hole cover 1520 may be integrally injection molded, without independent fabrication and assembling processes, such that production may be improved, with a reduced assembling time.

As the elastic rib 1526 is provided in the hole cover 1520, the elastic rib 1526 may be elastically deformed when coupling the shelf plate 600 to the coupling hole 1511, to provide the elastic force to the hole button 1522. The material used in forming the elastic rib 1526 may be, for example, a material having an elastic force such as silicon and the like.

In alternative embodiments, the structure may be formed in which the hole cover 1520 is integrally formed with the connection rib 1526*c*. Accordingly, not only the hole button 1522 inserted in the coupling hole 1511 having the shelf plate 600 coupled thereto, but also a neighboring hole button 1511, may be moved together. To prevent that, a structure may be provided in which each of the hole buttons 1522 and the corresponding elastic rib 1526 may function independently.

That is, the shelf may further include a cover holder 1530 configured to support the connection rib 1526*c* to prevent the movement of the connection rib 1526*c*. The cover holder 1530 may include a plurality of through holes 1532 configured to receive the elastically deformable first and second elastic ribs 1526*a* and 1526*b* therein, and a plurality of stoppers 1534 provided along circumferences of the through holes 1532, respectively, to support the connection ribs 1526*c* and prevent movement of the connection ribs 1526*c*.

As shown in FIG. 10, the cover holder 1530 may have a front portion and side portion(s) 536 extending back from two opposite ends of the front portion. The through holes 1532 and the stoppers 1534 may be provided in the front portion of the cover holder 1530. In other words, the cover holder 1530 may be formed in a bar shape having a "⊏" cross-section. After the hole cover 1520 is inserted in the opening 1513 of the frame body 1500, the cover holder 1530 may be inserted in the opening 1513 with the side portions 1526 thereof toward the opening 1513.

The plurality of the through holes 1532 may be formed through the front portion of the cover holder 1530. As shown in FIG. 10, the through holes 1532 may be arranged in positions corresponding to the first and second elastic ribs 1526*a* and 1526*b*.

As shown in FIGS. 10 and 11, the stopper(s) 1534 may be arranged along a circumference of the through hole(s) 1532 and support the connection rib 1526*b* behind. The stopper 1534 may partition two neighboring through holes 1532 to support the connection rib 1526*c* from a back side thereof.

Moreover, the cover holder 1530 may have a shape in which the side portion(s) 1536 widen outwardly. When the cover holder 1530 is inserted in the frame body 1510, the widened side portion(s) 1536 may be retracted to be inserted in the frame body 1510 such that the elastic force of the cover holder 1530 may prevent the cover holder 1530 from separating from the frame body 1510. For that, the cover holder 1530 may be formed of an elastic material.

Moreover, when the frame body 1500 is fixed to the rear surface of the refrigerator compartment 110, the side portion(s) 1536 of the cover holder 1530 may have a predetermined width to contact the rear surface of the refrigerator compartment 110 together with an end of the opening 1532. Accordingly, an end of the side portion 1536 may be supported by the rear surface of the refrigerator compartment 110 and the stopper 1534 may support the connection rib 1526*c* more effectively.

With the cover holder 1530 so provided, the hole button 1522 is pulled backward and the first and second elastic ribs 1526*a* and 1526*b* are elastically deformed to be inserted in the through holes 1522. After that, the rear portion of the connection rib 1526*c* is supported by the stopper 1534 to prevent the movement of the connection rib 1526*c*.

As shown in FIG. 12B, the other coupling holes 1511 having no shelf plate 600 fixed thereto may remain closed by the corresponding hole buttons 1522. Accordingly, the hole buttons 1522 may function independent from each other.

The opening and closing process of the coupling hole 1511 enabled by the hold cover 1520 will be described as follows, when the shelf plate 600 is fixed to or separated from the coupling hole 1511.

First, when fixing the shelf plate 600 to the coupling holes 1511, the first coupling part 612 of the shelf plate 600 is securely inserted in the securing groove 1519 provided in one of the coupling holes 1511 and the second securing part 614 is inserted in the corresponding coupling hole 1511.

Hence, as shown in FIG. 12B, the hole buttons 1522 corresponding to the coupling holes 1511 having the first and second securing parts 612 and 614 inserted therein may be pulled and moved backward by the first and second securing parts 612 and 614.

The hole buttons 1522 and the elastic ribs 1526 function independently, and only the hole button 1522 corresponding to the coupling hole 1511 where the shelf plate 600 is fixed selectively opens the corresponding coupling hole 1511, while the other coupling holes 1511 remain closed.

As the hole button 1522 is pulled backward, the first and second elastic ribs 1526*a* and 1526*b* connected with the corresponding hole buttons 1522 are elastically deformed to be inserted in the through holes 1533. A rear portion of the connection rib 1526*c* is supported by the stopper 1534 and movement of the connection rib 1526*c* may be prevented.

When separating the shelf plate 600 from the coupling hole 1511, the hole button 1522 is provided with elastic force by the first and second elastic ribs 1526*a* and 1526*b* and it returns to its original position. The first and second elastic ribs 1526*a* and 1526*b* may also return to original positions together with the hole button 1522.

A shelf assembly for a refrigerator according to another embodiment will be described as follows.

A shelf assembly 1450 for a refrigerator according to this embodiment to be installed in a storage compartment 110 of a refrigerator 10 may include a support frame 3500 and a shelf plate 1600. The support frame 3500 may include a frame body 1510 in which a plurality of coupling holes 3511*a* are spaced apart a predetermined distance along a longitudinal direction, and a hole cover 3530 configured to open and close the plurality of the coupling holes 3511*a*. The shelf plate 1600 coupled to the coupling holes 3511*a* may partition the storage chamber 110 into storage spaces. The hole cover 3530 may include a fixing part configured to fix the hole cover 3530 to an inner surface of the frame body 3510 and a plurality of opening/closing parts 3537 extending from the fixing part, corresponding to the plurality of the coupling holes 3511*a*, respectively, to be moved by the shelf plate 1600 to selectively open only one of the coupling holes 3511*a* in which the shelf plate 1600 is coupled.

Figure 13:
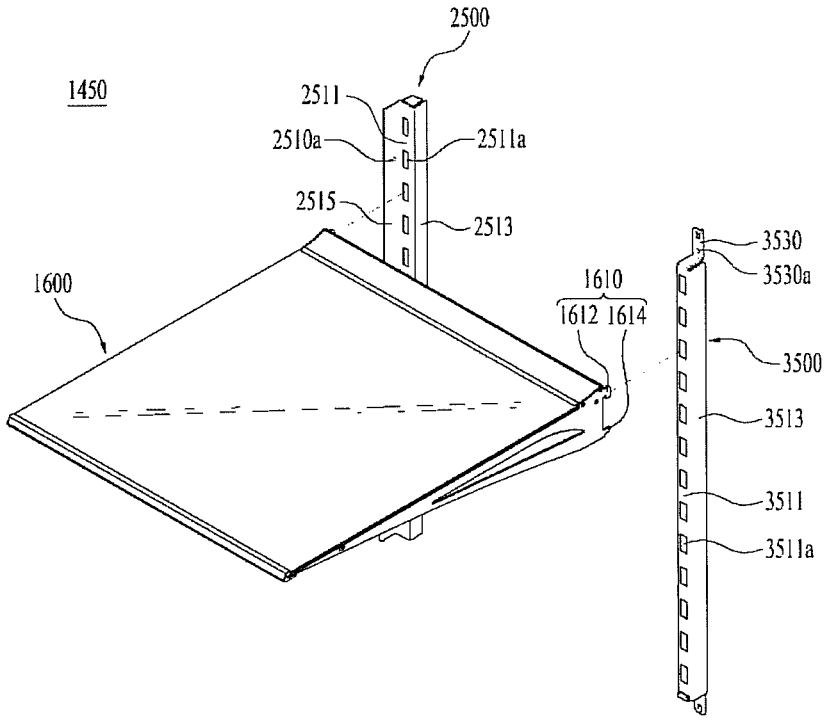
FIG. 13 is an exploded perspective view of a shelf assembly for a refrigerator according to another embodiment as broadly described herein.
Figure 14:
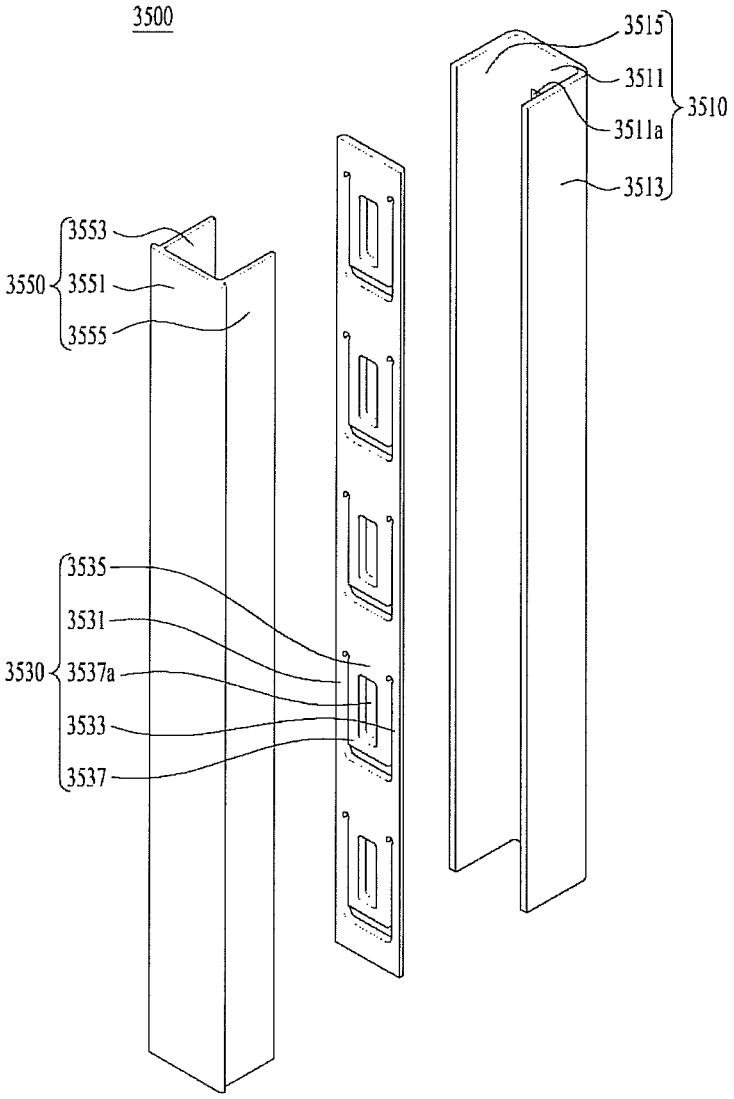
FIG. 14 is an exploded perspective view of a support frame shown in FIG. 13.
Figure 15:
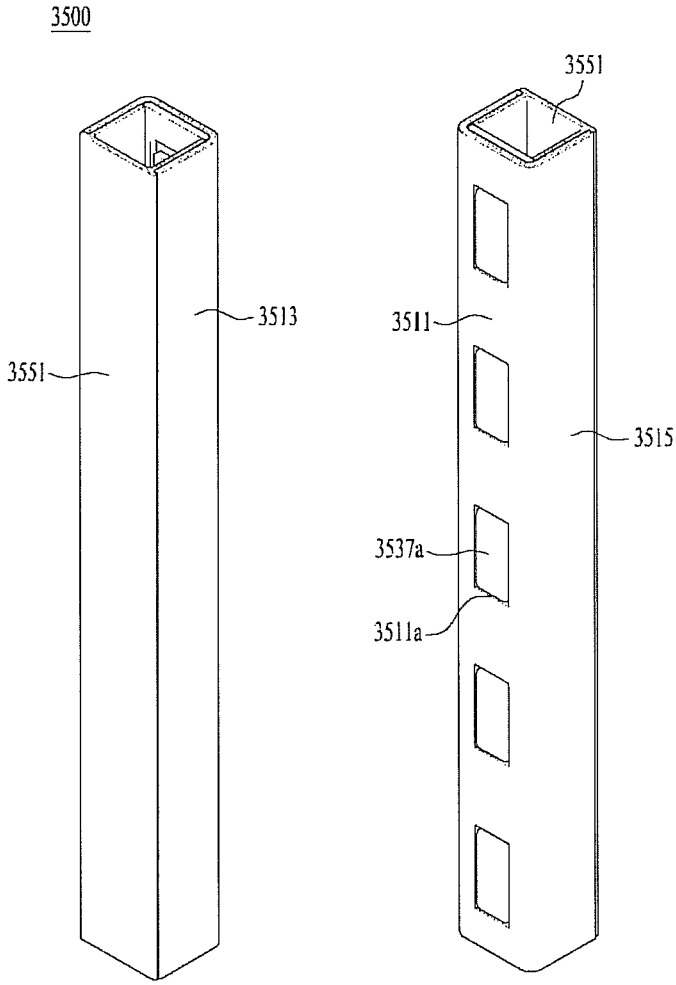
FIG. 15 is a perspective view of a coupled state of the support frame shown in FIG. 14.

Referring to FIGS. 13-15, the support frame of the shelf assembly for the refrigerator according to this embodiment will be described as follows. The same or repeated description in this embodiment will be omitted or reduced with respect to description of previous embodiments.

FIG. 13 is a perspective view of a shelf for a refrigerator, FIG. 14 is an exploded perspective view of a support frame shown in FIG. 13, and FIG. 15 is a perspective view of a coupled state of the support frame shown in FIG. 14.

The support frame 3500 may include the frame body 3510, the hole cover 1530 and the cover holder 3550. The support frame 3500 may be embedded in an exhaust duct provided in a wall of the refrigerator, for example, a center portion of a rear surface of the refrigerator compartment 110. However, other installation arrangements may also be appropriate, and the support frame 3500 may also/instead be installed in a corner of the refrigerator compartment 110.

The frame body 3510 may define an exterior appearance of the support frame and may include a coupling hole 3511 a, a front portion 3511 and first and second side portions 3531 and 3515.

As shown in FIG. 15, a plurality of coupling holes 3511*a* may be formed through the frame body 3510 along a longitudinal direction, spaced apart a predetermined distance from each other. A securing part 1610 of the shelf plate 1600 may be configured to be fixedly inserted in the coupling holes 3511*a*.

The front portion 3511 may define a front surface of the frame body 3510 and the coupling holes 3511*a* may be formed in the front portion 3511. The first and second side portions 3513 and 3515 may define side surfaces of the frame body 3510, respectively, and may extend back from two opposite ends of the first front portion 3511.

The frame body 3510 may be fastened to a rear surface of the refrigerator compartment 110 via fastening holes 3530*a* provided in coupling parts 3530 extending from upper and lower ends of the front portion 3511, respectively, by appropriate fasteners, such as, for example, bolts.

Hence, as shown in FIGS. 14 and 15, the hole cover 3530 extending along a longitudinal direction of the support frame 3500 is fixed to an inner surface of the frame body 3510 to selectively open and close the plurality of the coupling holes 3511*a*. Such a hole cover 330 may include a fixing part, a connecting part 3535 and an opening/closing part 3537.

The hole cover 3530 may be formed of various materials, such as, for example, a rubber material having elasticity. The hole cover 3530 may be integrally formed as one body, for example, in an injection molding process to simplify the fabrication process and reduce fabrication time.

The fixing part may be fixed to the inner surface of the frame body 3510 to fix the hole cover 3530 to the inner surface of the frame body 3510. The fixing part may include first and second fixing parts 3531 and 3533.

The first and second fixing parts 3531 and 3533 may fix the hole cover 3530 in the longitudinal direction of the frame body 3510, along both a right edge and a left edge of the coupling hole 3511*a*.

Referring to FIG. 14, the first and second fixing parts 3531 and 3533 may have a longitudinally extended shape along a longitudinal direction of the frame body 3510 and may be fixed along right and left edges of the coupling hole 3511*a*. Accordingly, the first and second fixing parts 3531 and 3533 may fix the hole cover 3530 in the inner surface of the frame body 3510 along the longitudinal direction of the frame body 3510. The connecting part 3535 may connect the first and second fixing parts 3531 and 3533 with each other. A plurality of connecting parts 3535 may extend between an upper and lower portion between neighboring coupling holes 3511*a*.

Referring to FIG. 14, the connecting part 3535 may extend horizontally from the first and second fixing parts 3531 and 3533 to connect the first and second fixing parts 3531 and 3533 with each other. The connecting part 3535 may extend vertically between neighboring coupling holes 3511*a*. In other words, the connecting part 3535 may be configured to connect the first and second fixing parts 3531 and 3533 with each other, not covering the coupling hole 3511*a*.

In particular, when the first securing part 1612 of the shelf plate 1600 is secured to the coupling hole 3511*a*, the connecting part 3535 may be arranged distant from the coupling hole 3511*a* downward from the coupling hole 3511*a* so that it does not contact the first securing part 1612.

Each opening/closing part 3537 may extend from the fixing part corresponding to its respective coupling hole 3511*a* to open and close each of the coupling holes 3511*a*. The opening/closing part 3537 is moved by the shelf plate 1600 to selectively open only the coupling hole 3511*a* having the shelf plate 1600 coupled thereto. In this instance, the opening/closing part 3537 may extend horizontally from the first or second fixing part 3531 or 3533 to cover each of the coupling holes 3511*a* or may extend vertically from the connecting part 3535.

However, in a case in which the support frame 3511*a* is installed in a flat wall of the refrigerator compartment 110, two shelf plates 1600 may be coupled to one coupling hole 3511*a*. Considering that, the opening/closing part 3537 may extend downward from a lower end of the connection part 3535 to-cover the coupling hole 3511*a* as shown in FIG. 14. Accordingly, even when two shelf plates 1600 are secured to one coupling hole 3511*a*, the opening/closing part 3537 may be gently pulled by the securing part 1610 of the shelf plate 1600.

Each opening/closing part 3537 may cover the corresponding coupling hole 3511*a* from the inner surface of the frame body 3510 to open and close each coupling hole 3511*a* independently. In particular, the opening/closing part 3537 may selectively open only the coupling hole 3511*a* having the shelf plate 1600 secured thereto. Each opening/closing part 3537 may include an opening/closing pad 3537*a* formed in a shape corresponding to the coupling hole 3511*a*, to be inserted in the coupling hole 3511*a*.

Referring to FIG. 14, the opening/closing pad 3537*a* may be projected from a front surface of the opening/closing part 3535 toward the coupling hole 3511*a* to have the shape corresponding to the coupling hole 3511*a*. Accordingly, as shown in FIG. 15, each opening/closing pad 3537*a* may be inserted in the coupling hole 3511*a* from an inner surface of the frame body 3510 to fill the coupling hole 3511*a*.

Hence, the cover holder 3550 may be inserted in the frame body 3510 to press and fix the first and second fixing parts 3531 and 3533. The cover holder 3550 may also include a contacting part 3551 contacting and pressed by one surface of the storage compartment 110, and first and second pressing parts 3553 and 3555 pressing and fixing the first and second fixing parts 3531 and 3533.

The cover holder 3550 may be formed of various materials such as, for example, an elastic material that enables separation and coupling from and to the frame body 3510. The cover holder 3550 may be. integrally formed in a compression molding process. Accordingly, the fabrication process may be simplified and the fabrication and assembling time may be reduced.

As shown in FIG. 14, the contacting part 3551 may be formed as a plate extending in a longitudinal direction of the frame body 3510, to close an open surface formed by the first and second side portions 3513 and 3515 of the frame body 3510.

The first and second pressing parts 3553 and 3555 may be formed in a symmetrical shape and may extend from the inner surface of the contacting part 3551 toward the first and second fixing parts 3531 and 3533, respectively. Accordingly, the first and second pressing parts 3553 and 3555 may be inserted in the frame body 3510, to contact the first and second fixing parts 3531 and 3533, respectively. The first and second pressing parts 3553 and 3555 may widen outward to prevent the cover holder 3550 from easily separating from the frame body 3510.

A method of fixing the hole cover 3530 using the cover holder 3510 will be described. First, the cover holder 3550 is coupled to the frame body 3510 so that the first and second pressing parts 3553 and 3555 contact the first and second fixing parts 3531 and 3533, respectively.

Hence, the frame body 3510 is installed in one surface of the refrigerator compartment 110. Accordingly, the frame body 3510 may be fastened to the one surface of the refrigerator compartment 110 by an appropriate fastener via the fastening holes 3530*a* provided in the hole cover 3530. After that, the rear surface of the contacting part 3511 may contact one surface of the refrigerator compartment 110 to press the surface.

As a result, the first and second pressing parts 3553 and 3555 may fixedly press the first and second fixing parts 3531 and 3533. In other words, the cover holder 3550 may pressingly fix the first and second fixing parts 3531 and 3533.

The shelf plate 1600 having the securing part 1610 according to this embodiment is essentially the same as that of the shelf plate according to the previously described embodiment and thus further detailed description thereof will be omitted accordingly.

Figure 16:
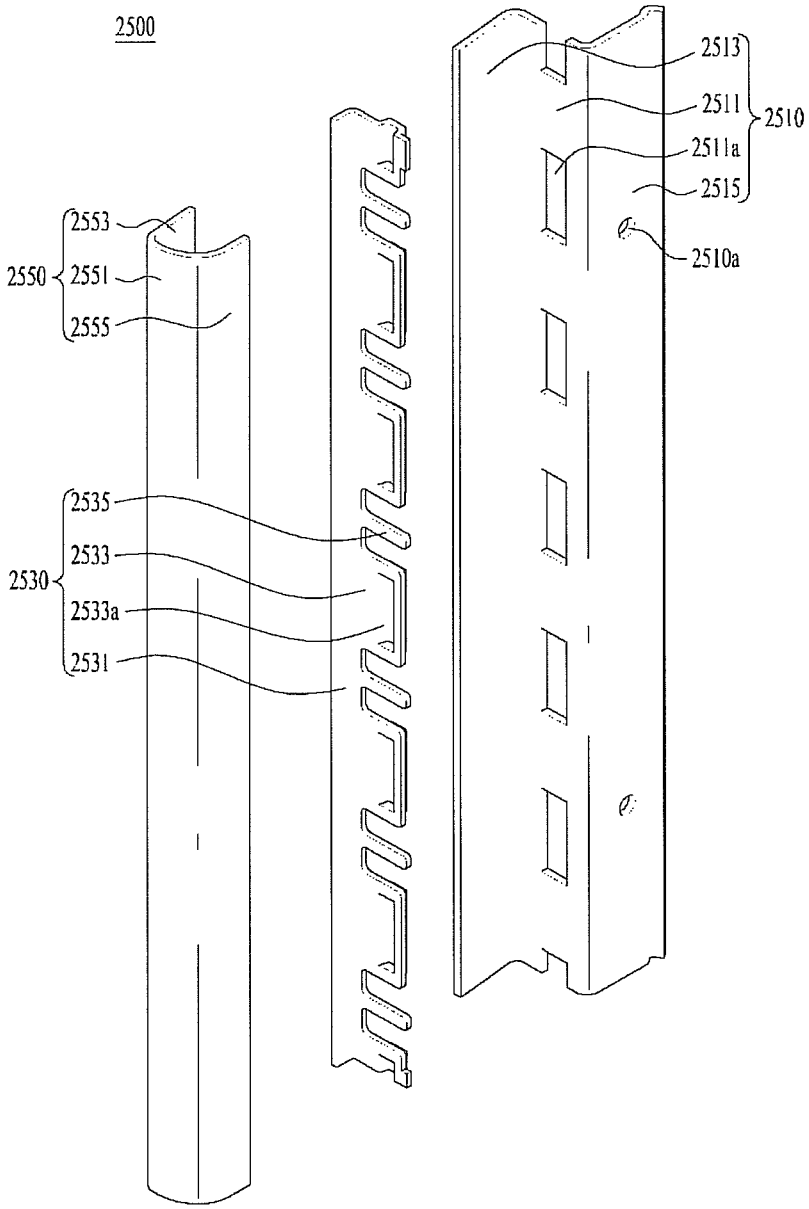
FIG. 16 is an exploded perspective view of a support frame provided in a shelf assembly for a refrigerator according to another embodiment as broadly described herein.

A support frame 2500 for a shelf assembly as shown in FIG. 16 may be fixed to a corner of the storage compartment 110, with a cover holder 2550 arranged between the support frame 2500 and the corner of the storage compartment 110 to fixedly press the hole cover 2530. The support frame 2500 may include a frame body 2510 in which a plurality of coupling holes 2511*a* are spaced apart a predetermined distance from each other, and a hole cover 2530 configured to open and close the plurality of coupling holes 2511*a*. The hole cover 2530 may include a fixing part configured to fix the hole cover 2530 to an inner surface of the frame body 2510 and a plurality of opening/closing parts 2535 extended from the fixing part, corresponding to the plurality of coupling holes 2511*a*, to open and close the plurality of coupling holes 2511*a*, respectively. The plurality of opening/closing parts 2535 may be selectively moved by the shelf plate 1600 to selectively open only one of the coupling holes 2511*a* having the shelf plate 1600 secured thereto.

Figure 17:
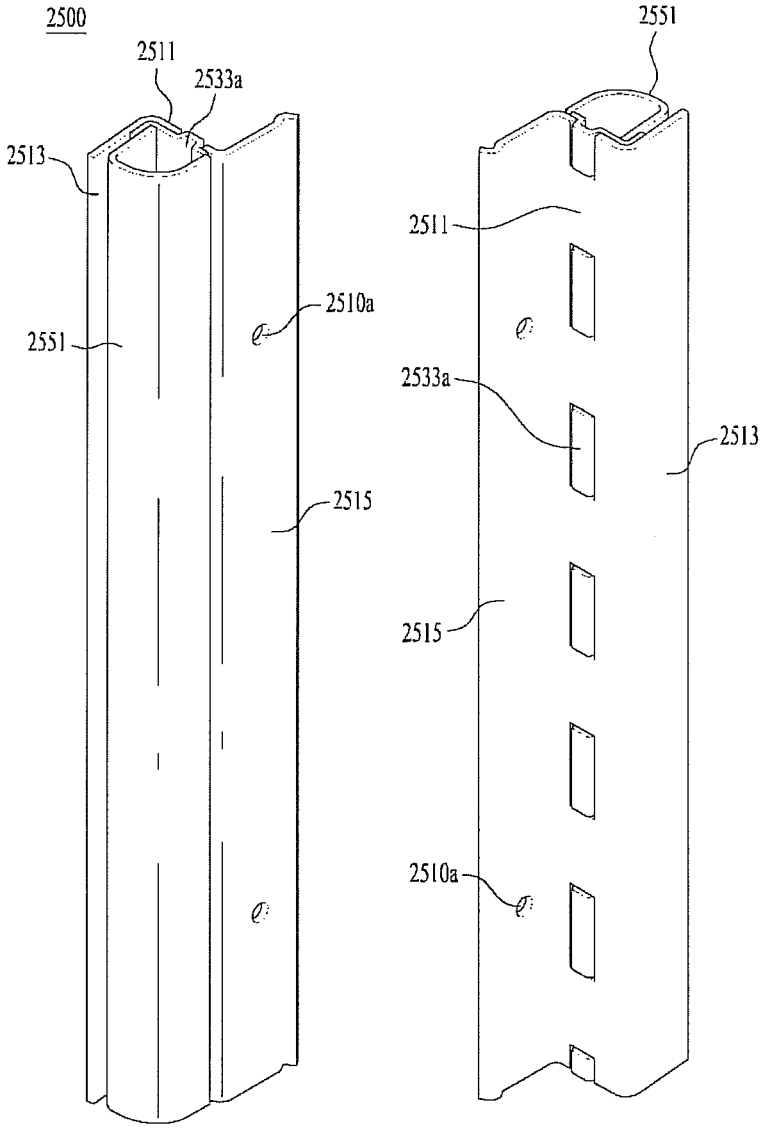
FIG. 17 is a perspective view of a coupled state of the support frame shown in FIG. 16.

FIG. 16 is an exploded perspective view of the support frame, and FIG. 17 is a perspective view of a coupled state of the support frame.

The support frame 2500 according to this embodiment may include the frame body 2510, the hole cover 2530, and the cover holder 2550. The support frame 2500 may be used as a support frame for a corner of the refrigerator 10 (see FIG. 1). The frame body 2510 may define an exterior appearance of the support frame 2500, and may include a front portion 2511, coupling holes 2511*a* and first and second side portions 2513 and 2515. The front portion 2511 may define a front surface of the frame body 2510 and the coupling holes 2511*a* may be formed in the front portion 2511. The first side portion 2513 may extend back from a first end of the front portion 2511 and the second side portion 2515 may extend forward from a second end of the front portion 2511.

In other words, both the first and second side portions 3513 and 3515 extend toward the rear of the front portion 3511 in the embodiment show in FIGS. 13 and 14. However, in this embodiment, the first and second side portions 2513 and 2515 extended in opposite directions.

Accordingly, the support frame 2500 may be fixedly fastened to one side surface of the refrigerator compartment 110 via a fastening hole 2510 provided in the second side portion 2515 by an appropriate fastener, such that the support frame 2500 may be arranged in the corner of the refrigerator compartment 110.

Hence, a shape of the hole cover 2530 may extend along a longitudinal direction of the frame body 2510 and may be fixed to an inner surface of the frame body 2510, to selectively open and close the plurality of coupling holes 2511*a*. The hole cover 2530 may include the fixing part and the opening/closing part 2535.

The fixing part may be fixed to the inner surface of the frame body 2510 to fix the hole cover 2530 to the inner surface of the frame body 2510. The fixing part may include a first fixing part 2531 and a second fixing part 2533.

In particular, the first fixing part 2531 may fix the hole cover 2530 in a longitudinal direction of the frame body 2510, along one of a right edge or a left edge of the coupling hole 2511*a*.

The second fixing part 2533 may extend horizontally from the first fixing part 2531 to the other edge of the coupling hole 2511*a* to extend vertically between neighboring coupling holes 2511*a*.

As shown in FIG. 16, the first fixing part 2531 may extend in a longitudinal direction of the frame body 2510 and may be fixed along one of a right edge or a left edge of the coupling hole 2511*a*. Accordingly, the first fixing part 2531 may fix the hole cover 2530 to the inner surface of the frame body 2510.

As shown in FIG. 16, the second fixing part 2533 may extend horizontally from the first fixing part 2531 from one of a right edge or a left edge of the coupling hole 2511*a* having the first fixing part fixed thereto to the other edge. Also, the second fixing part 2533 may extend vertically neighboring coupling holes 2511*a*, so as to not cover the coupling holes 2511*a*.

When the securing part 1610 of the shelf plate 1600 is secured to the coupling hole 2511*a*, the second fixing part 2533 may be arranged distant from the coupling hole 2511*a* downward, not to contact with the first securing part 1612.

Hence, the opening/closing part 2535 may be horizontally extended from the first fixing part 2531 to cover each of the coupling holes 2511*a* as shown in FIG. 16.

As mentioned above, considering that two shelf plates 1600 may be fixed to one coupling hole 1511*a* in the embodiment shown in FIGS. 13 and 14, the opening/closing part 3537 extends downward from the connection part 3535. However, in this embodiment, the support frame 2500 is used as a support frame for a corner and one shelf plate 1600 is fixed to one coupling hole 2511*a*. Accordingly, even when the opening/closing part 2535 extends horizontally from the first fixing part 2531, the opening/closing part may be gently pulled by the securing part 1610.

As shown in FIG. 16, each opening/closing part 2535 may include opening/closing pad 2535*a* having a shape corresponding to the coupling hole(s) 2511*a* so as to be inserted in the coupling hole(s) 2511*a*. The opening/closing pad 2535*a* may project from the opening/closing part 2535 toward the coupling hole 2511*a*. Accordingly, as shown in FIG. 17, the opening/closing pad 2535*aa* may be inserted in the coupling hole 2511*a* from an inner surface of the frame body 2510 to fill the coupling hole 2511*a*.

Hence, the cover holder 2550 may be inserted in the frame body 2510 to press and fix the first and second fixing parts 2531 and 2533. The cover holder 2550 may also include a contacting part 2551 in contact with and pressed by one corner of the storage compartment 110, and first and second pressing parts 2553 and 2555 pressing and fixing the first and second fixing parts 2531 and 2533.

As shown in FIG. 16, the cover holder 2550 may have a bar shape extending longitudinally. The contacting part 2551 is provided at a rear end of the cover holder 2550to contact a rear surface of the refrigerator compartment 110. The first and second pressing parts 2553 and 2555 may extend from the contacting part 2551 forward to press and fix the first and second fixing parts 2531 and 2433.

The first pressing part 2553 may be formed in a plate shape to be attachable to the first side portion 2513, with an end in contact with the first fixing part 2531. Together with that, the second pressing part 2555 may be formed in a curved shape, with and end in contact with the second fixing part 2533 and one surface of the refrigerator compartment 110.

To fix the hole cover using the cover holder 2550, first, the first and second pressing parts 1553 and 2555 temporarily fix the cover holder 2550 to the frame body 2510 so that the first and second pressing parts 1553 and 2555 contact the first and second fixing parts 2531 and 2533. To temporarily fix the cover holder 2550 to the frame body 2510, for example, the first pressing part 2553 may be attached to an inner surface of the first side portion 2513 by double-sided tape to arrange the second cover holder 2550 in a proper position before fixing the frame body 2510 to the corner of the refrigerator compartment 110.

Hence, the frame body 2510 having the cover holder 2550 temporarily fixed thereto may be fixed to the corner of the refrigerator compartment 110.

Accordingly, the contacting part 2551 may press against and contact the rear surface of the refrigerator 110 and the first and second pressing parts 2553 and 2555 may fixedly press the first and second fixing parts 2511 and 2513. In other words, the cover holder 2550 presses the first and second fixing parts 2531 and 2533, to fix the hole cover 2530 to the frame body 2510. Moreover, the second pressing part 2555 may contact one surface of the refrigerator compartment 110 to be pressed. After that, the first pressing part 1553 may be pressed toward the first side portion 2513 and may be attached to the first side portion 2513 by the double-sided tape more strongly.

As shown in FIG. 16, an end of the first fixing part 2531 may be bent to contact an inner surface of the first side portion 2513. The first pressing part 2553 presses the bent end of the first fixing part 2531, to fix the first fixing part 2531 more strongly. In a case in which one of the opening/closing parts 2535 is pulled by the securing part 1610 of the shelf plate 1600, the pulling motion may be prevented from affecting neighboring opening/closing parts 2535. In other words, each of the opening/closing parts 2535 may function independently to enable selective opening of the coupling hole(s) 2511*a* performed by the opening/closing part(s) 2535.

The support frame 2500 of this embodiment may have a symmetrical shape in a vertical direction. Accordingly, the support frame 2500 may be freely arranged in a corner of the refrigerator compartment 110, regardless of right and left directions.

Figure 18A:
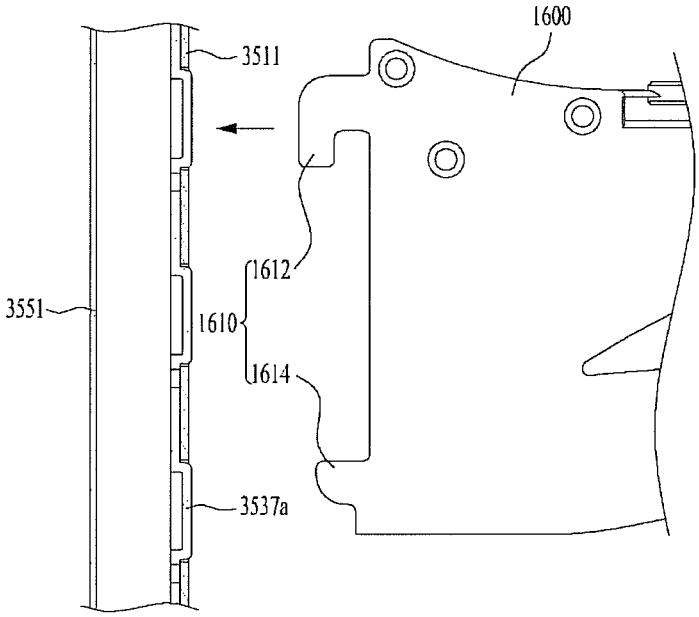
FIGS. 18A and 18B are sectional views illustrating a coupling relation between the support frame and the shelf plate of the shelf assembly shown in FIG. 13.
Figure 18B:
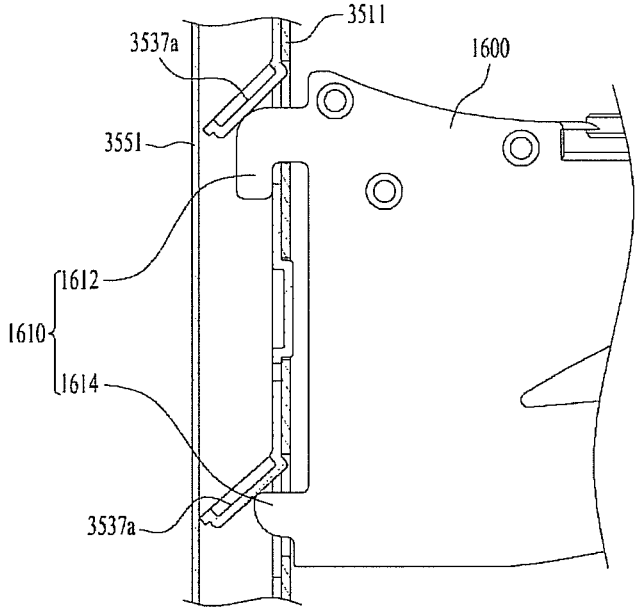

Referring to the accompanying drawings, the coupling relation between the support frame 3500 and 2500 and the shelf plate 1600 according to the embodiments shown in FIGS. 13-14 and FIGS. 15-17 will be described as follows. FIGS. 18A and 18B are sectional views illustrating a coupling relation between the support frame and the shelf plate shown in FIGS. 13 and 14, and FIGS. 19A and 19B are sectional views illustrating a coupling relation between the support frame and a shelf plate shown in FIGS. 15-17.

As mentioned above, the plate shaped support frame 3500 may be arranged on a rear surface of the refrigerator compartment 110 and the support frame 2500 may be arranged in each of right and left corners of the refrigerator compartment 110.

As shown in FIGS. 18A and 18B, the securing part 1610 of the shelf plate 1600 may be fixedly inserted in the coupling hole 3511*a* of the support frame for the plate type as follows.

Before the securing part 1610 is inserted in the coupling hole 3511*a*, the coupling hole 3511*a* is closed by the opening/closing part 3537 and the opening/closing pad 3537*a*. In this state, the securing part 1610 is inserted in the coupling hole 3511*a* and the opening/closing part 3537 is pulled by the securing part 1610 backward accordingly. As an upper end of the opening/closing part 3537 is connected with the connecting part 3535, the opening/closing part 3537 is rotated on an upper end of the connecting part 3535, to open the coupling hole 3511*a*.

However, even when the securing part 1610 is inserted, the hole cover 3530 remains fixed by the first and second fixing parts 3531 and 3533. Accordingly, the remaining coupling holes 3511*a* (other than the coupling hole 3511*a* opened by the securing part 1610) remain closed by the opening/closing part 3537. As the opening/closing part 3537 is provided in the hole cover 3530, only the coupling hole 3511*a* having the securing part 1610 inserted therein may be selectively open.

Figure 19A:
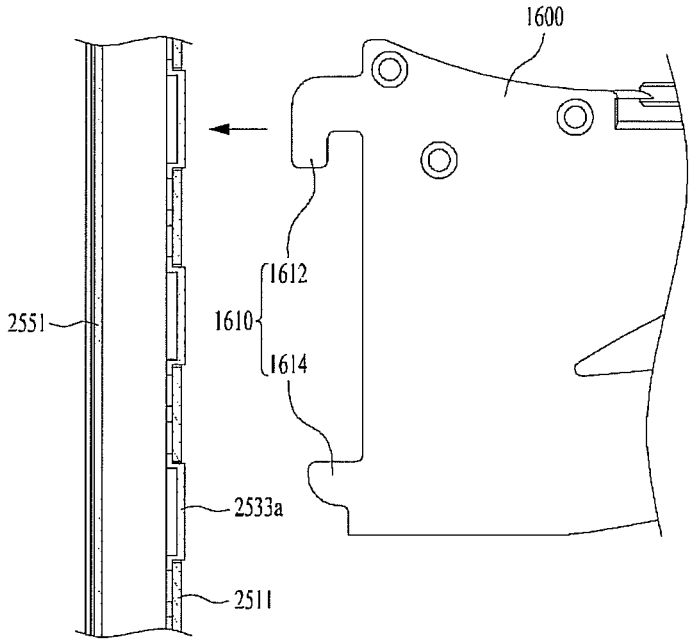
FIGS. 19A and 19B illustrate a coupling relation between the support frame and a shelf plate of the shelf assembly shown in FIG. 16.
Figure 19B:
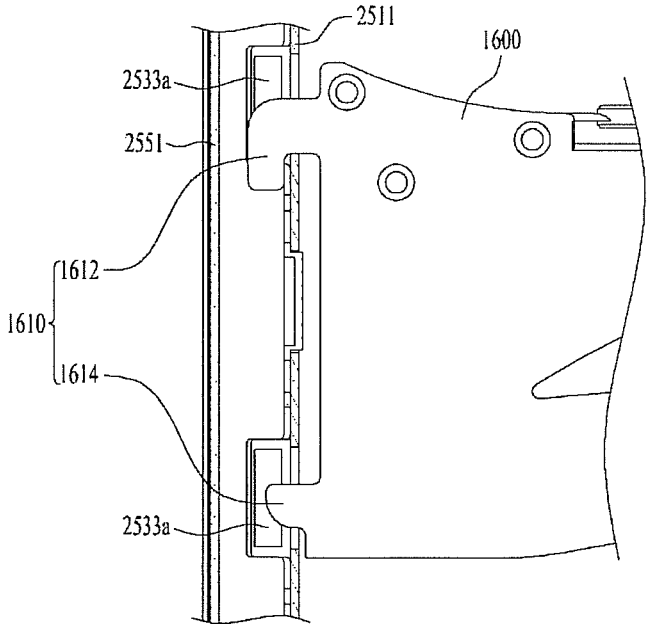

Referring to FIGS. 19A and 19B, it will be described how the securing part 1610 of the shelf plate 1600 is fixedly inserted in the coupling hole 2511*a* of the support frame 2500 for the corner. Before the securing part 1610 is inserted in the coupling hole 2511*a*, the coupling hole 2511*a* is closed by the opening/closing part 2535 and the opening/closing pad 2535*a* as shown in FIG. 19A. In this state, the securing part 1610 is inserted in the coupling hole 2511 *a* and the opening/closing part 2535 may be pulled backward by the securing part 1610.

In this embodiment, an end of the opening/closing part 2535 provided in the support frame 2500 is connected with the first fixing part 2531. Accordingly, as shown in FIG. 19B, the opening/closing part 2535 is rotated on the end connected with the first fixing part 2531 to open the coupling hole

2511*a*. However, even when the securing part 1610 is inserted, a closed state of the hole cover 2530 may be maintained by the first and second fixing parts 2531 and 2533 such that the opening/closing part 2535 may selectively open only the coupling hole 2511*a* where the securing part 1610 is inserted.

Figure 20:
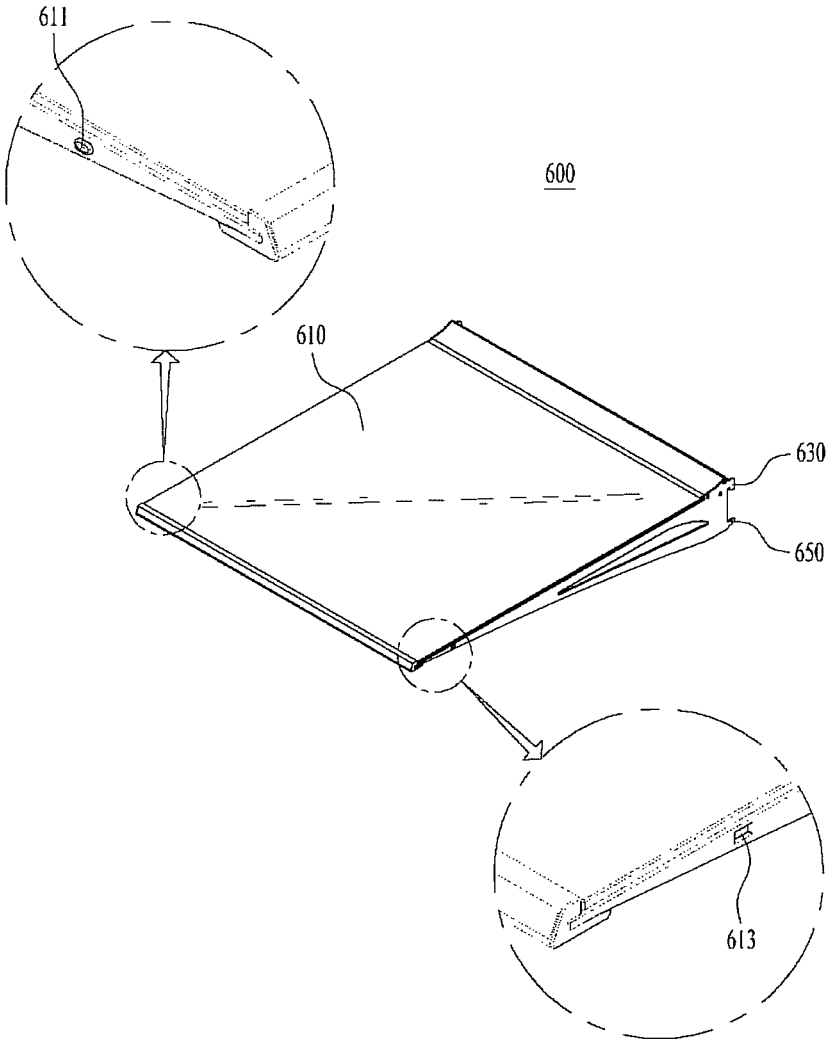
FIG. 20 is a perspective view of a shelf including coupling members being formed at both opposite sides of the shelf plate in accordance with another embodiment as broadly described herein.
Figure 21:
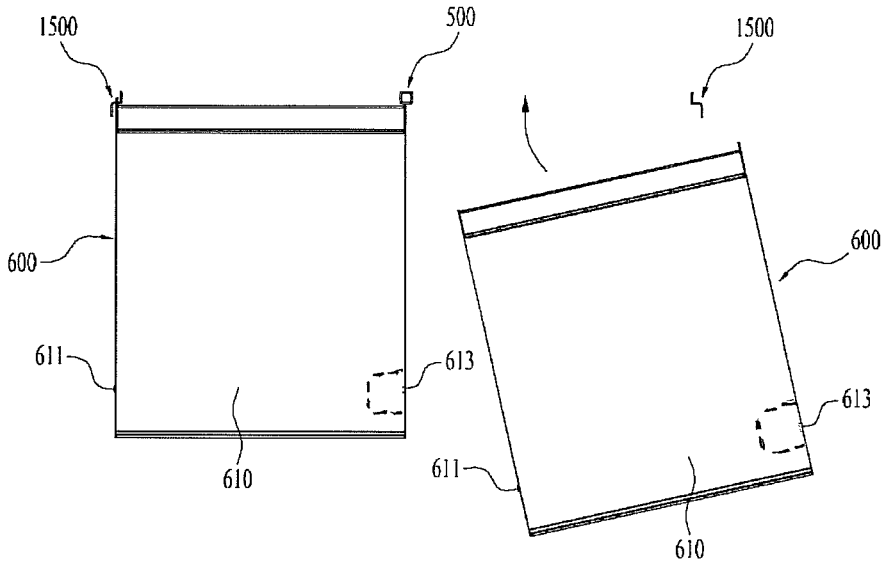
FIG. 21 is a top view of a coupling relationship between neighboring shelf plates having sides in contact with each other, in accordance with another embodiment as broadly described herein.

FIGS. 20 and 21 illustrate a coupling relationship between neighboring shelf plates 600 having sides in contact with each other, in accordance with embodiments as broadly described herein.

When three or more support frames 500/1500 or 3500/2500 are arranged in an inner case 100 of a refrigerator 10, spaced apart a predetermined distance from each other, as shown in FIG. 1, the shelf plates 600 may be arranged in two lines or more. Accordingly, the plurality of shelf plates 600 may be freely arranged in various lines having the same height or different heights as appropriate for particular storage requirements.

In the exemplary embodiment shown in FIG. 1, two shelf plates 600 are arranged at the same height, with adjacent sides of the shelf plates 600 contacting each other. The shelf plates 600 may be dislocated by an unevenly distributed load, detracting from their aesthetic appearance.

A shelf 20 in accordance with another embodiment may include shelf coupling members provided in lateral sides of the shelf plates 600, to couple the neighboring shelf plates 600 fixed to the support frame 500.

Such a shelf coupling member may include a coupling projection 611 that projects outward from a first lateral side of each shelf plate 600 toward a neighboring shelf plate 600, and a coupling groove 613 provided in a second side of each shelf plate 600 to receive a coupling projection 611 of the neighboring shelf plate 600.

As shown in FIG. 20, a first side surface of the shelf plate body 610 may have the coupling projection 611 projecting therefrom, and the coupling groove 613 may be formed in a second side surface of the shelf plate body 610, corresponding to the coupling projection 611 of the neighboring shelf plate body 610.

As shown in FIG. 21, a first shelf plate 600 may be installed in the inner case 100 first, and then a second shelf plate 600 may be installed with a side thereof in contact with a side of the first shelf plate 600. In this instance, the coupling projection 611 provided in the second shelf plate 600 may be inserted in the coupling groove 613 provided in the first shelf plate 600, to couple the first and second shelf plates 600.

As a result, even when a load is applied to the shelf plates 600, by storage items or other factors, neighboring shelf plates 600 having sides in contact with each other may maintain the same height without being dislocated.

In the embodiment shown in FIGS. 20 and 21, the coupling projection 611 and the coupling groove 613 form the shelf coupling member. However, other coupling arrangements may be used to couple adjacent sides of the shelf plates 600 as appropriate.

A shelf and a refrigerator having such a shelf are provided, and may be capable of preventing foreign objects from entering a coupling hole provided in a support frame.

A shelf and a refrigerator having such a shelf are provided, and may allow neighboring shelf plates having sides in contact with each other to be coupled to each other, without being dislocated.

A shelf and a refrigerator having such a shelf are provided, and may have a relatively simple structure and manufacturing process, with low manufacturing cost.

A shelf as embodied and broadly described herein, which may be installed in a surface of a predetermined room desired to partition, may include a support frame fixed to a surface of the partitioned room, the support frame comprising a support frame body having a plurality of coupling holes formed along a longitudinal direction, and a cover member for opening and closing the plurality of the coupling holes; and a shelf plate fixed to the coupling hole to partition the room, wherein the cover member includes a fixing portion for fixing the cover member to an inner surface of the support frame body; and a plurality of opening/closing portions extended from the fixing portion, corresponding to the plurality of the coupling holes, the plurality of the opening/closing portions moved by the shelf plate to open only a coupling hole having the shelf plate fixed thereto selectively.

In accordance with another embodiment as broadly described herein, a shelf, installed in a surface of a predetermined room desired to partition, may include a support frame arranged in a corner of the partitioned room, the support frame comprising a support frame body having a plurality of coupling holes and a cover member for opening and closing the plurality of the coupling holes; a shelf plate fixed to the coupling hole to partition the room; and a cover holder arranged between the support frame body and a corner of the partitioned room, to press and fix the cover member, wherein the cover member includes a fixing portion for fixing the cover member to an inner surface of the support frame body; and a plurality of opening/closing portions extended from the fixing portion, corresponding to the plurality of the coupling holes, the plurality of the opening/closing portions moved by the shelf plate to open only a coupling hole having the shelf plate fixed thereto selectively.

In accordance with another embodiment as broadly described herein, a, a refrigerator may include an inner case comprising a storage room in which foods are stored; a support frame comprising a support frame body in which a plurality of coupling holes are formed, spaced apart a predetermined distance along a longitudinal direction, and a cover member for opening and closing the plurality of the coupling holes, the support frame fixed to a surface of the inner case; and a shelf plate fixed to the coupling holes to partition the storage room, wherein the cover member includes a fixing portion for fixing the cover member to an inner surface of the support frame body; and a plurality of opening/closing portions extended from the fixing portion, corresponding to the plurality of the coupling holes, the plurality of the opening/closing portions moved by the shelf plate to open only a coupling hole having the shelf plate fixed thereto selectively.

In a shelf and a refrigerator as embodied and broadly described herein, only the used coupling holes of the support frame may be selectively opened by the cover member. Accumulation of foreign objects in the coupling holes may be prevented and refrigerator hygiene may be enhanced.

Furthermore, the coupling holes of the support frame may be closed by the cover member. Accordingly, the support frame is not exposed via the coupling holes and aesthetic appearance may be maintained.

Still further, the cover member may be integrally formed by injection molding and the cover holder may be integrally formed by extrusion molding. Accordingly, the manufacturing process may be simple and the manufacturing cost may be reduced. Such an integrally formed cover member and cover holder may simplify the structure of the support frame and reduce the time taken to assemble the support frame.

Additionally, the shelf coupling member provided in the shelf plate may enable the neighboring shelf plates having side surfaces in contact with each other to be coupled to each other simply.

A shelf for a refrigerator installed in a storage compartment of a refrigerator as embodied and broadly described herein may include a support frame fixed to one surface of the storage compartment, the support frame including a frame body having a plurality of coupling holes spaced apart a predetermined distance from each other in a longitudinal direction; and a hole cover configured to open and close the plurality of the coupling hole; a shelf plate coupled to the coupling holes, to partition the storage compartment into storage spaces, wherein the hole cover includes a plurality of hole buttons movably inserted in the plurality of the coupling holes, respectively, to open and close the plurality of the coupling holes, the plurality of the hole buttons configured to open and close only a coupling hole having the shelf plate coupled thereto, while being moved by the shelf plate fixed one of the coupling holes.

A shelf for a refrigerator installed in a storage compartment of a refrigerator in accordance with another embodiment as broadly described herein may include a support frame fixed to one surface of the storage compartment, the support frame including a frame body having a plurality of coupling holes spaced apart a predetermined distance from each other in a longitudinal direction and a hole cover configured to open and close the plurality of the coupling holes; and a shelf plate coupled to the coupling holes, to partition the storage compartment into storage spaces, wherein the hole cover includes a fixing part configured to fix the hole cover to an inner surface of the frame body; and a plurality of opening/closing parts extended from the fixing part, corresponding to the plurality of the coupling holes, respectively, to open and close the coupling holes, the plurality of the opening/closing parts moved by the shelf plate to selectively open only the coupling hole having the shelf plate coupled thereto.

A shelf for a refrigerator installed in a storage compartment of a refrigerator in accordance with another embodiment as broadly described herein may include a support frame fixed to one surface of the storage compartment, the support frame comprising a frame body having a plurality of coupling holes spaced apart a predetermined distance from each other in a longitudinal direction and a hole cover configured to open and close the plurality of the coupling holes; and a shelf plate coupled to the coupling holes, to partition the storage compartment into storage spaces; and a cover holder arranged between the support frame and a corner of the storage compartment, to fixedly press the hole cover, wherein the hole cover includes a fixing part configured to fix the hole cover to an inner surface of the frame body; and a plurality of opening/closing parts extended from the fixing part, corresponding to the plurality of the coupling holes, to open and close the coupling holes, the plurality of the opening/closing parts moved by the shelf plate to selectively open only the coupling holes having the shelf plate fixed thereto.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A shelf for a storage compartment of a refrigerator, the shelf comprising:

a support frame configured to be fixed to a surface of the storage compartment, the support frame comprising:

a frame body having a plurality of coupling holes formed therein, spaced apart a predetermined distance from each other in a longitudinal direction; and a hole cover coupled to the frame body, the hole cover comprising:

a fixing part that fixes the hole cover to an inner surface of the frame body;

a plurality of hole buttons respectively received in the plurality of coupling holes and configured to move with respect to the plurality of coupling holes so as to selectively open and close the plurality of coupling holes; and a plurality of connecting parts elastically connecting the plurality of hole buttons to the fixing part; and a shelf plate coupled to one of the plurality of coupling holes to provide a storage surface in the storage compartment, wherein the plurality of hole buttons of the hole cover are configured to move to an open position in response to insertion of the shelf plate therein such that only a coupling hole having the shelf plate inserted therein is open, with remaining coupling holes of the plurality of coupling holes remaining closed by the plurality of hole buttons of the hole cover.

2. The shelf of claim 1, wherein the support frame further comprises a guide that extends inward from each of the plurality of coupling holes to guide movement of the plurality of hole buttons.

3. The shelf of claim 1, wherein the hole cover further comprises a separation protrusion that extends from an outer circumferential surface of each of the plurality of hole buttons to prevent separation of the hole buttons from their respective coupling holes.

4. The shelf of claim 1, wherein each of the plurality of connecting parts comprises a restoration part configured to restore the hole button corresponding to the one of the plurality of coupling hole in which the shelf plate is inserted to an original position when the shelf plate is separated from the one of the plurality of coupling holes.

5. The shelf of claim 4, wherein the restoration part comprises a plurality of elastic ribs configured to provide an elastic force to the plurality of hole buttons.

6. The shelf of claim 5, wherein each of the plurality of elastic ribs comprises:

a first rib that extends from a corresponding hole button in a first direction; and a second rib that extends from the corresponding hole button in a second direction that is different from the first direction, wherein the first rib and the second rib are configured to be elastically deformed in response to insertion of the shelf plate into the corresponding coupling hole to selectively provide elastic force to the corresponding hole button.

7. The shelf of claim 6, wherein the first and second ribs each comprises a bent portion to provide a respective elastic force.

8. The shelf of claim 6, wherein each of the plurality of hole buttons further comprises a projected portion projecting a predetermined distance from a rear surface thereof, wherein the first and second ribs each extend from the projected portion of their respective hole button.

9. The shelf of claim 6, further comprising a plurality of connecting ribs, wherein each connecting rib is configured to connect the first elastic rib of one hole button and the second elastic rib of a neighboring hole button with each other.

10. The shelf of claim 9, further comprising:

a cover holder coupled to the frame body and configured to support the plurality of connecting ribs and prevent movement of the plurality connecting ribs.

11. The shelf of claim 10, wherein the cover holder comprises:

a plurality of through holes formed through a predetermined portion of the cover holder such that the elastically deformed first and second ribs are received therein; and a plurality of stoppers respectively provided at circumferential portions of each of the plurality of through holes to prevent movement of the plurality of connecting ribs.

12. A shelf for a storage compartment of a refrigerator, the shelf comprising:

a support frame fixed to a surface of the storage compartment, the support frame comprising:

a frame body having a plurality of coupling holes spaced apart a predetermined distance from each other in a longitudinal direction; and a hole cover coupled to the frame body, the hole cover comprising:

a fixing part that fixes the hole cover to an inner surface of the frame body;

a plurality of opening/closing parts extending from the fixing part and corresponding to the plurality of coupling holes to respectively open and close the plurality of coupling holes; and a plurality of connecting parts elastically connecting the plurality of opening/closing parts to the fixing part a shelf plate coupled to the coupling holes to partition the storage compartment; and at least one of the plurality of coupling holes to provide a storage surface in the storage compartment, wherein each of the plurality of opening/closing parts is configured to move in response to insertion of the shelf plate to selectively open only the coupling hole having the shelf plate coupled thereto.

13. The shelf of claim 12, wherein the frame body comprises:

a front face; and first and second side faces respectively extending from two opposite ends of the front face.

14. The shelf of claim 12, wherein the fixing part comprises first and second fixing parts configured to fix the hole cover to the frame body along right and left edges of the plurality of coupling holes, respectively.

15. The shelf of claim 14, wherein the plurality of connecting parts are configured to connect the first and second fixing parts with each other, wherein the plurality of connecting parts extend vertically between neighboring coupling holes of the plurality of coupling holes, and wherein the plurality of opening/closing parts extend vertically from respective the connecting parts of the plurality of connecting parts.

16. The shelf of claim 15, further comprising:

a cover holder received in the frame body and pressing against the first and second fixing parts.

17. The shelf of claim 16, wherein the cover holder comprises:

a contacting part that contacts and is pressed by the surface of the storage compartment to which the support frame is fixed; and first and second pressing parts each extending from the contacting part and pressing the first and second fixing parts as the first contacting part is pressed.

18. A shelf for a storage compartment of a refrigerator, the shelf comprising:

a support frame fixed to a surface of the storage compartment, the support frame comprising:

a frame body having a plurality of coupling holes formed therein, spaced apart a predetermined distance from each other in a longitudinal direction; and a hole cover coupled to the frame body;

a shelf plate coupled to the coupling holes to partition the storage compartment; and a cover holder arranged between the support frame and a corner of the storage compartment to press and fix the hole cover, wherein the hole cover comprises:

a fixing part configured to fix the hole cover to an inner surface of the frame body;

a plurality of opening/closing parts extending from the fixing part, at positions corresponding to the plurality of coupling holes, to respectively open and close the plurality of coupling holes; and a plurality of connecting parts elastically connecting the plurality of opening/closing parts to the fixing part, wherein each of the plurality of opening/closing parts is configured to move in response to insertion of the shelf plate into a corresponding coupling hole to selectively open only the corresponding coupling hole having the shelf plate coupled thereto.

19. The shelf of claim 18, wherein the frame body comprises:

a front face in which the plurality of coupling holes are formed;

a first side face extending backward from a first end of the front face; and a second side face extending forward from a second end of the front face.

20. The shelf of claim 18, wherein the fixing part comprises a first fixing part configured to fix the hole cover in a longitudinal direction of the frame body along one of a right edge or a left edge of the plurality of coupling holes, wherein each of the plurality of opening/closing parts extend horizontally from the first fixing part.

21. The shelf of claim 20, wherein the hole cover further comprises a second fixing part extending horizontally from the first fixing part to the other of the right edge or the left edge of the plurality of coupling holes so as to extend vertically between neighboring coupling holes.

22. The shelf of claim 21, wherein the cover holder presses and fixes the first and second fixing parts.

23. The shelf of claim 22, wherein the cover holder comprises:

a contacting part that contacts and is pressed by the surface of the storage compartment to which the support frame is fixed; and first and second pressing parts each extending from the contacting part to press the first and second fixing parts as the contacting part is pressed.

* * * * *